US009706845B2

(12) United States Patent
Battey et al.

(10) Patent No.: US 9,706,845 B2
(45) Date of Patent: Jul. 18, 2017

(54) CHAIR ASSEMBLY

(71) Applicant: Steelcase Inc., Grand Rapids, MI (US)

(72) Inventors: Robert J. Battey, Middleville, MI (US); Kurt R. Heidmann, Grand Rapids, MI (US); Gordon J. Peterson, Rockford, MI (US); Todd T. Andres, Sparta, MI (US)

(73) Assignee: Steelcase Inc., Grand Rapids, MI (US)

( * ) Notice: Subject to any disclaimer, the term of this patent is extended or adjusted under 35 U.S.C. 154(b) by 152 days.

(21) Appl. No.: 14/029,255

(22) Filed: Sep. 17, 2013

(65) Prior Publication Data

US 2014/0077558 A1 Mar. 20, 2014

Related U.S. Application Data

(60) Provisional application No. 61/703,677, filed on Sep. 20, 2012, provisional application No. 61/703,667, filed on Sep. 20, 2012, provisional application No. 61/703,666, filed on Sep. 20, 2012, provisional application No. 61/703,663, filed on Sep. 20, 2012, provisional application No. 61/703,659, filed on Sep.

(Continued)

(51) Int. Cl.

| | |
|---|---|
| ***A47C 1/032*** | (2006.01) |
| ***A47C 1/023*** | (2006.01) |
| ***A47C 3/30*** | (2006.01) |
| ***A47C 7/46*** | (2006.01) |

(52) U.S. Cl.

CPC ..... *A47C 1/032* (2013.01); *A47C 1/023* (2013.01); *A47C 1/03255* (2013.01); *A47C 1/03266* (2013.01); *A47C 3/30* (2013.01); *A47C 7/462* (2013.01)

(58) Field of Classification Search

CPC ..... A47C 1/032
USPC ..... 297/316, 340; 248/560
See application file for complete search history.

(56) References Cited

U.S. PATENT DOCUMENTS

| | | | |
|---|---|---|---|
| 1,686,341 | A | 10/1928 | Nathanson |
| 2,240,802 | A | 5/1941 | Sandberg et al. |

(Continued)

FOREIGN PATENT DOCUMENTS

| | | |
|---|---|---|
| CA | 2782824 | 10/2007 |
| DE | 36 05 809 | 8/1987 |

(Continued)

OTHER PUBLICATIONS

The Hague; Supplementary European Search Report; May 11, 2016.

*Primary Examiner* — Timothy J Brindley
(74) *Attorney, Agent, or Firm* — Price Heneveld LLP

(57) ABSTRACT

A chair assembly includes a seat support structure having a seat surface pivotable about a first pivot point between first and second positions, and a back support assembly coupled to the seat support structure, movable between upright and reclined positions and pivotable about a second pivot point, wherein the first pivot point is located at a position along a first line perpendicular to a second line tangential to the seat surface and at a forward most portion of a back surface, forward between along a third line parallel with the second line, down to the second line along a fourth line perpendicular with the second line, up the fourth line such that the second pivot point is located within a given radius from the first pivot point when the back support assembly is in the upright and reclined positions.

24 Claims, 41 Drawing Sheets

Related U.S. Application Data

20, 2012, provisional application No. 61/703,661, filed on Sep. 20, 2012, provisional application No. 61/754,803, filed on Jan. 21, 2013.

(56) References Cited

U.S. PATENT DOCUMENTS 2,321,385 A 6/1943 Herold
2,471,024 A 5/1949 Cramer
2,497,395 A 2/1950 Cramer
2,643,704 A 6/1953 Lauterbach
2,679,285 A 5/1954 Martin et al.
2,679,286 A 5/1954 Martin et al.
2,796,918 A 6/1957 Martin et al.
2,859,801 A 11/1958 Moore
2,985,226 A 5/1961 Maurer et al.
3,116,093 A 12/1963 Bosack
3,139,305 A 6/1964 Mizelle
3,369,840 A 2/1968 Dufton
3,913,975 A 10/1975 Carter
4,073,538 A 2/1978 Hunter
4,143,910 A 3/1979 Geffers et al.
4,200,332 A 4/1980 Brauning
4,311,338 A 1/1982 Moorhouse
4,384,741 A 5/1983 Flum et al.
4,411,469 A 10/1983 Drabert et al.
4,452,449 A 6/1984 Propst
4,471,994 A 9/1984 Zund et al.
4,478,454 A 10/1984 Faiks
4,496,190 A 1/1985 Barley
4,641,885 A 2/1987 Brauning
4,682,814 A 7/1987 Hansen
4,744,600 A 5/1988 Inoue
4,773,706 A * 9/1988 Hinrichs ..... A47C 1/03294 297/300.5
4,783,036 A 11/1988 Vossoughi
4,796,952 A 1/1989 Piretti
4,826,123 A 5/1989 Hannah et al.
4,842,333 A 6/1989 Meiller
4,844,387 A 7/1989 Sorgi et al.
4,848,841 A * 7/1989 Giselsson ..... 297/423.13
4,854,641 A 8/1989 Reineman et al.
4,966,411 A 10/1990 Katagiri et al.
4,979,778 A 12/1990 Shields
4,988,145 A 1/1991 Engel
5,058,347 A 10/1991 Schuelke et al.
5,071,189 A 12/1991 Kratz
5,076,645 A 12/1991 Yokota
5,193,880 A 3/1993 Keusch et al.
5,195,801 A 3/1993 Franck et al.
5,203,853 A 4/1993 Caruso
5,224,758 A 7/1993 Takamatsu et al.
5,249,839 A 10/1993 Faiks et al.
5,251,958 A 10/1993 Roericht et al.
5,288,138 A 2/1994 Stulik et al.
5,318,345 A 6/1994 Olson
5,354,120 A 10/1994 Voelkle
5,366,274 A 11/1994 Roericht et al.
5,425,566 A 6/1995 Buchacz
5,433,509 A 7/1995 Hotary et al.
5,582,459 A 12/1996 Hama et al.
5,636,898 A 6/1997 Dixon et al.
5,655,814 A 8/1997 Gibbs
5,658,045 A 8/1997 Van Koolwijk et al.
5,660,439 A * 8/1997 Unwalla ..... A47C 1/03294 297/300.2
5,743,595 A 4/1998 Kirdulis
5,765,804 A 6/1998 Stumpf et al.
5,772,282 A 6/1998 Stumpf et al.
5,775,774 A 7/1998 Okano
5,799,917 A 9/1998 Li
5,810,440 A 9/1998 Unwalla
5,826,940 A 10/1998 Hodgdon
5,868,467 A 2/1999 Moll
5,944,382 A 8/1999 Ambasz
6,035,901 A 3/2000 Stumpf et al.
6,059,368 A 5/2000 Stumpf et al.
6,086,034 A 7/2000 McAllister et al.
6,109,694 A 8/2000 Kurtz
6,120,096 A 9/2000 Miotto
6,125,521 A 10/2000 Stumpf et al.
6,386,634 B1 5/2002 Stumpf et al.
6,394,549 B1 5/2002 DeKraker et al.
6,431,649 B1 8/2002 Hensel
6,513,874 B1 2/2003 Sander et al.
6,517,156 B1 2/2003 Lin
6,523,896 B1 2/2003 Uhlenbrock
6,588,842 B2 7/2003 Stumpf et al.
6,592,090 B1 7/2003 Li
6,607,244 B2 8/2003 Stulik et al.
6,609,691 B2 8/2003 Oddsen, Jr.
6,609,755 B2 8/2003 Koepke et al.
6,644,749 B2 11/2003 VanDeRiet et al.
6,669,292 B2 12/2003 Koepke et al.
6,669,294 B2 12/2003 Kinoshita et al.
6,692,075 B2 2/2004 Sander
6,695,404 B2 2/2004 Bruske
6,702,390 B2 3/2004 Stumpf et al.
6,709,057 B2 3/2004 Sander
6,722,741 B2 4/2004 Stumpf et al.
6,726,286 B2 4/2004 Stumpf et al.
6,733,080 B2 5/2004 Stumpf et al.
6,758,523 B2 7/2004 VanDeRiet et al.
6,769,657 B1 8/2004 Huang
6,837,546 B2 1/2005 VanDeRiet et al.
6,896,329 B2 5/2005 Sander
6,913,316 B2 7/2005 Kinoshita et al.
6,923,503 B2 8/2005 Sangiorgio
6,929,327 B2 8/2005 Piretti
6,945,602 B2 9/2005 Fookes et al.
6,955,402 B2 10/2005 VanDeRiet et al.
6,957,862 B2 10/2005 Chen
6,966,604 B2 11/2005 Stumpf et al.
7,066,537 B2 6/2006 Coffield et al.
7,213,880 B2 5/2007 Schmitz et al.
7,213,886 B2 5/2007 Schmitz et al.
7,234,772 B2 6/2007 Wells
7,249,802 B2 7/2007 Schmitz et al.
7,267,405 B2 9/2007 Tin
7,273,253 B2 9/2007 Deimen et al.
7,322,653 B2 1/2008 Dragusin
7,419,222 B2 9/2008 Schmitz et al.
7,425,037 B2 9/2008 Schmitz et al.
7,472,962 B2 1/2009 Caruso et al.
7,566,039 B2 7/2009 Hung
7,594,700 B2 9/2009 Stumpf et al.
7,600,814 B2 10/2009 Link
7,625,045 B2 12/2009 Hatcher et al.
7,677,515 B2 3/2010 Oddsen, Jr. et al.
7,677,654 B2 3/2010 Enberg et al.
7,740,315 B2 6/2010 Ball et al.
7,794,022 B2 9/2010 Caruso et al.
7,806,478 B1 * 10/2010 Cvek ..... A47C 1/03255 297/300.1
7,841,570 B2 11/2010 Mileos et al.
7,841,666 B2 11/2010 Schmitz et al.
7,850,244 B2 12/2010 Salewski
8,047,612 B2 11/2011 Titz
8,070,230 B2 12/2011 Krob et al.
8,087,729 B2 1/2012 Kladde
8,662,586 B2 * 3/2014 Serber ..... 297/316
9,004,597 B2 * 4/2015 Battey et al. ..... 297/300.5
9,022,476 B2 * 5/2015 Battey et al. ..... 297/300.2
2001/0028188 A1 10/2001 Stumpf et al.
2002/0180252 A1 12/2002 Kinoshita et al.
2009/0127905 A1 5/2009 Schmitz et al.
2009/0242700 A1 * 10/2009 Raymond ..... 244/118.6
2010/0259081 A1 10/2010 Kuno
2011/0193387 A1 8/2011 Kim

(56) References Cited

U.S. PATENT DOCUMENTS

| | | | | |
|---|---|---|---|---|
| 2011/0291452 | A1* | 12/2011 | Ko | 297/340 |
| 2014/0028068 | A1* | 1/2014 | Birkbeck | 297/340 |

FOREIGN PATENT DOCUMENTS

| | | |
|---|---|---|
| DE | 3700862 | 7/1988 |
| DE | 3743013 | 6/1989 |
| DE | 10 2011 105290 | 12/2011 |
| EP | 017816 | 4/1986 |
| EP | 0240389 | 10/1987 |
| EP | 0281845 | 9/1988 |
| EP | 1579787 | 9/2005 |
| EP | 1915925 | 4/2008 |
| EP | 2070444 | 6/2009 |
| EP | 2095741 | 9/2009 |
| EP | 2187782 | 5/2010 |
| EP | 2233044 | 9/2010 |
| EP | 2351500 | 8/2011 |
| JP | 0517206 | 12/1992 |
| JP | 10179315 | 7/1998 |
| JP | 2007152145 | 6/2007 |
| JP | 2007175520 | 7/2007 |
| JP | 2011041614 | 3/2011 |
| JP | 2013022078 | 2/2013 |
| JP | 2013039340 | 2/2013 |
| WO | 02102197 | 12/2002 |
| WO | 02102199 | 12/2002 |
| WO | 03068025 | 8/2003 |
| WO | 2007112236 | 10/2007 |
| WO | 2008112918 | 9/2008 |
| WO | 2008112919 | 9/2008 |
| WO | 2010071282 | 6/2010 |
| WO | 2012170863 | 12/2012 |

* cited by examiner

CHAIR ASSEMBLY

CROSS REFERENCE TO RELATED APPLICATIONS

This application claims the benefit of U.S. Provisional Patent Application 61/703,677 filed Sep. 20, 2012, entitled "CHAIR ASSEMBLY," 61/703,667 filed Sep. 20, 2012, entitled "CHAIR ARM ASSEMBLY," 61/703,666 filed Sep. 20, 2012, entitled "CHAIR ASSEMBLY WITH UPHOLSTERY COVERING," 61/703,663 filed Sep. 20, 2012, entitled "CHAIR BACK MECHANISM AND CONTROL ASSEMBLY," 61/703,659 filed Sep. 20, 2012, entitled "CONTROL ASSEMBLY FOR CHAIR," 61/703,661 filed Sep. 20, 2012, entitled "CHAIR ASSEMBLY," and 61/754,803 filed Sep. 20, 2012, entitled "CHAIR ASSEMBLY WITH UPHOLSTERY COVERING," the entire disclosures of which are incorporated herein by reference.

BACKGROUND OF THE INVENTION

The present invention relates to a chair assembly, and in particular to an office chair assembly comprising a reclinable back assembly and a seat assembly, wherein the back assembly and seat assemblies are each pivotable about pivot points that remain within a particular distance from one another as the assemblies are pivoted.

BRIEF SUMMARY OF THE INVENTION

One aspect of the present invention is to provide a chair assembly that comprises a seat support structure including a seat surface adapted to support a seated user, wherein the seat support structure is pivotable about a first pivot point between a first seat position and a second seat position, and a back support assembly operably coupled to the seat support structure and including a back support adapted to support a seated user, wherein the back support assembly is movable between a fully upright position and a fully reclined position, the seat support structure is located in the first position when the back support assembly is in the fully upright position and in the second position when the back support assembly is in the fully reclined position, and wherein the back support assembly is pivotable about a second pivot point. The chair assembly further comprises that the first pivot point is located at a position along a first line that is perpendicular to a second line tangential to the seat surface and that is tangential with a forward most portion of the back surface located where the first line contacts the back surface, then forward between about 2.64 inches and about 3.64 inches along a third line that is parallel with the second line, then down to the second line along a fourth line perpendicular with the second line, and then up the fourth line between about 2.04 inches and about 3.04 inches from the second line to the first pivot point, and wherein the second pivot point is located within a radius of less than or equal to about 0.75 inches from the first pivot point when the back support assembly is in the fully upright position and within a radius of about 0.75 inches from the first pivot point when the back support assembly is in the fully reclined position.

Another aspect of the present invention is to provide a chair assembly that comprises a seat support structure including a seat surface adapted to support a seated user, wherein the seat support structure is pivotable about a first pivot point between a first seat position and a second seat position, and a back support assembly operably coupled to the seat support structure and including a back surface adapted to support a seated user, wherein the back support assembly is movable between a fully upright position and a fully reclined position, the seat support structure is located in the first seat position when the back support assembly is in the fully upright position and in the second position when the back support assembly is in the fully reclined position, and wherein the back support assembly is pivotable about a second pivot point. The chair assembly further comprises that wherein the first pivot point is adapted to be collocated with an H-point of a seated user when the back support assembly is in the fully upright position and when the back support assembly is in the fully reclined position, and wherein the second pivot point is adapted to be located within a radius of less than or equal to about 0.75 inches from the H-point of a seated user when the back support assembly is in the fully upright position and when the back support assembly is in the fully reclined position.

Yet another aspect of the present invention is to provide a chair assembly that comprises a seat support structure including a seat surface adapted to support a seated user, wherein the seat support structure is pivotable about a first pivot point between a first seat position and a second seat position, and a back support assembly operably coupled to the seat support structure and including a back surface adapted to support a seated user, wherein the back support assembly is movable between a fully upright position and a fully reclined position, the seat support structure is located in the first position when the back support assembly is in the fully upright position and in the second position when the back support assembly is in the fully reclined position, and wherein the back support assembly is pivotable about a second pivot point. The chair further comprises that wherein the first pivot point is adapted to be located within a radius of less than or equal to about 0.75 inches from an H-point of a seated user when the back support assembly is in the fully upright position and when the back support assembly is in the fully reclined position, and wherein the second pivot point is adapted to be located within a radius of less than or equal to about 0.75 inches from the H-point of a seated user when the back support assembly is in the fully upright position and when the back support assembly is in the fully reclined position.

These and other features and advantages of the present invention will be further understood and appreciated by those skilled in the art by reference to the following specification, claims and appended drawings.

DETAILED DESCRIPTION OF THE PREFERRED EMBODIMENTS

Figure 1:
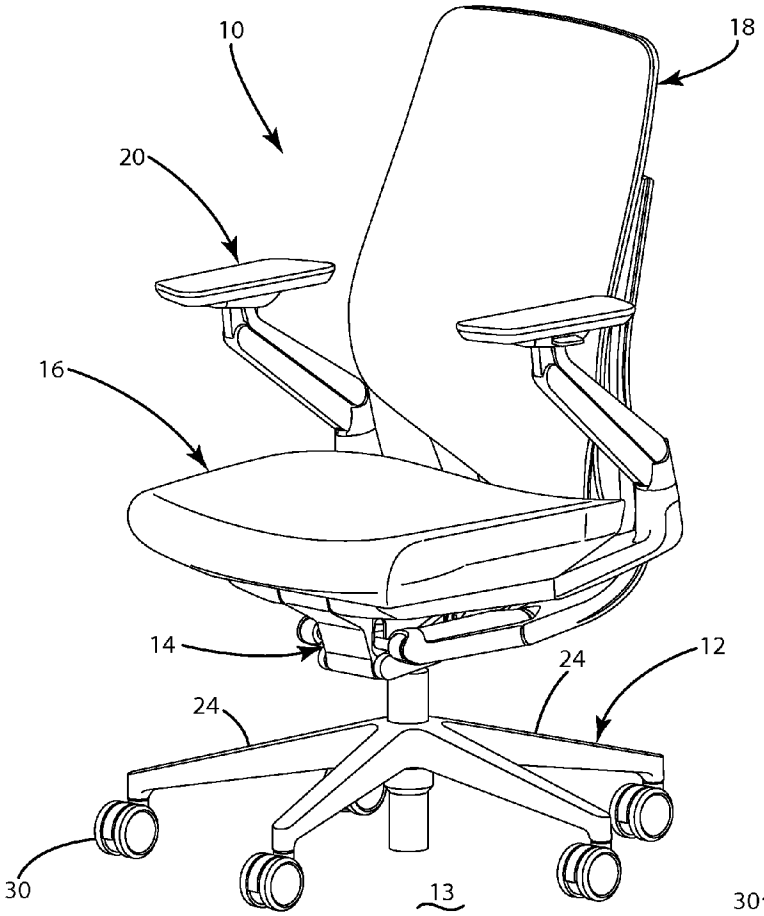
FIG. 1 is a front perspective view of a chair assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise. Various elements of the embodiments disclosed herein may be described as being operably coupled to one another, which includes elements either directly or indirectly coupled to one another. Further, the term "chair" as utilized herein encompasses office chairs, vehicle seating, home seating, stadium seating, theater seating, and the like.

Figure 2:
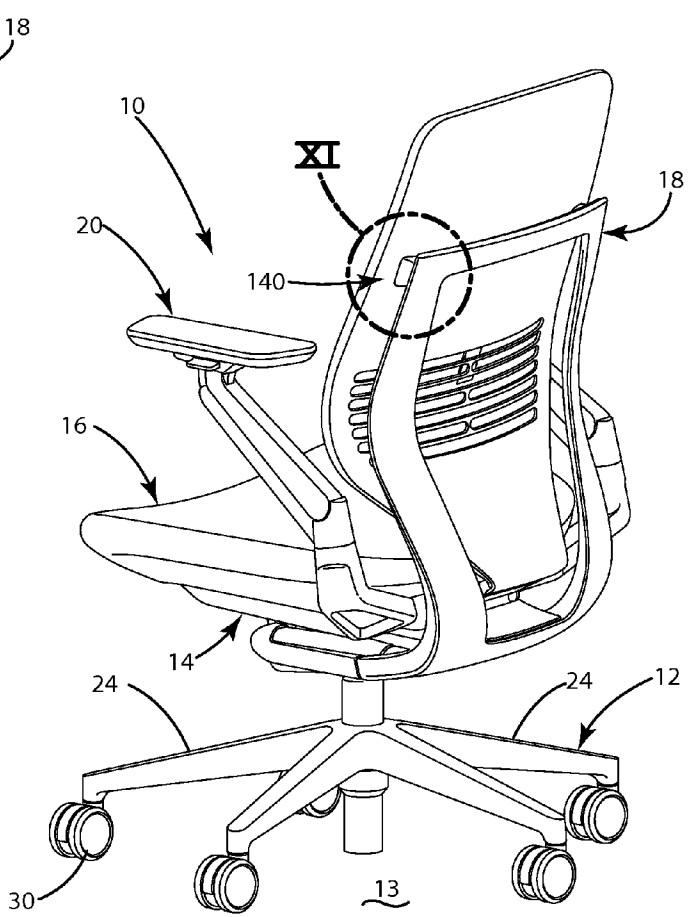
FIG. 2 is a rear perspective view of the chair assembly.
Figure 4:
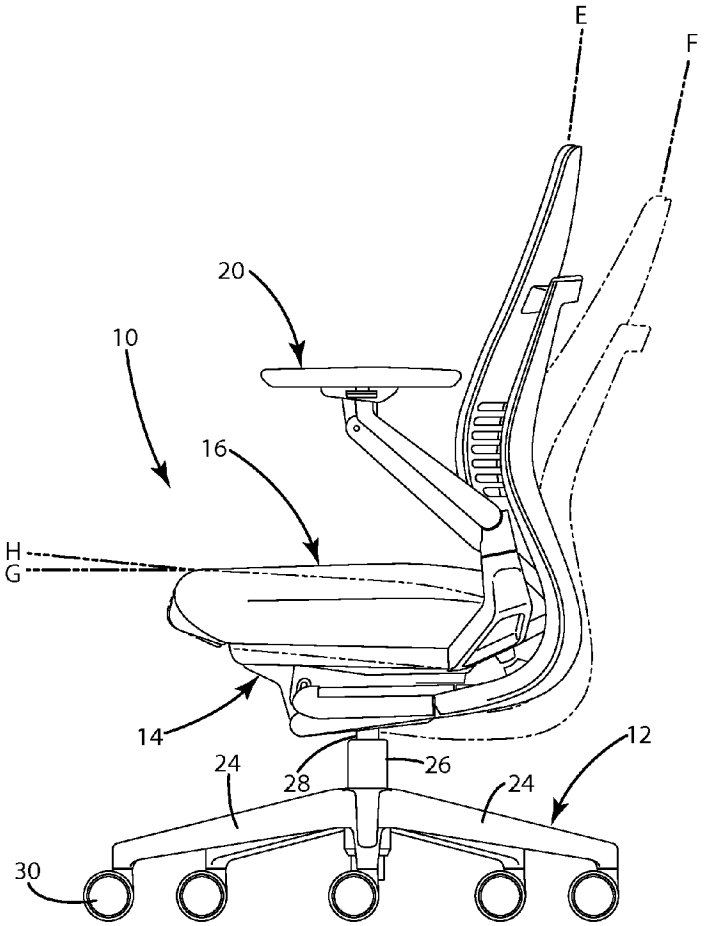
FIG. 4 is a side elevational view of the chair assembly showing the chair assembly in an upright position and in a reclined position in dashed line.

The reference numeral 10 (FIGS. 1 and 2) generally designates a chair assembly embodying the present invention. In the illustrated example, the chair assembly 10 includes a castered base assembly 12 abutting a supporting floor surface 13, a control or support assembly 14 supported by the castered base assembly 12, a seat assembly 16 and back assembly 18 each operably coupled with the control assembly 14, and a pair of arm assemblies 20. The control assembly 14 (FIG. 3) is operably coupled to the base assembly 12 such that the seat assembly 16, the back assembly 18 and the arm assemblies 20 may be vertically adjusted between a fully lowered position A and a fully raised position B, and pivoted about a vertical axis 21 in a direction 22. The seat assembly 16 is operably coupled to the control assembly 14 such that the seat assembly 16 is longitudinally adjustable with respect to the control assembly 14 between a fully retracted position C and a fully extended position D. The seat assembly 16 (FIG. 4) and the back assembly 18 are operably coupled with the control assembly 14 and with one another such that the back assembly 18 is movable between a fully upright position E and a fully reclined position F, and further such that the seat assembly 16 is movable between a fully upright position G and a fully reclined position H corresponding to the fully upright position E and the fully reclined position F of the back assembly 18, respectively.

The base assembly 12 includes a plurality of pedestal arms 24 radially extending and spaced about a hollow central column that receives a pneumatic cylinder 28 therein. Each pedestal arm 24 is supported above the floor surface 13 by an associated caster assembly 30. Although the base assembly 12 is illustrated as including a multiple-arm pedestal assembly, it is noted that other suitable supporting structures maybe utilized, including but not limited to fixed columns, multiple leg arrangements, vehicle seat support assemblies, and the like.

Figure 5:
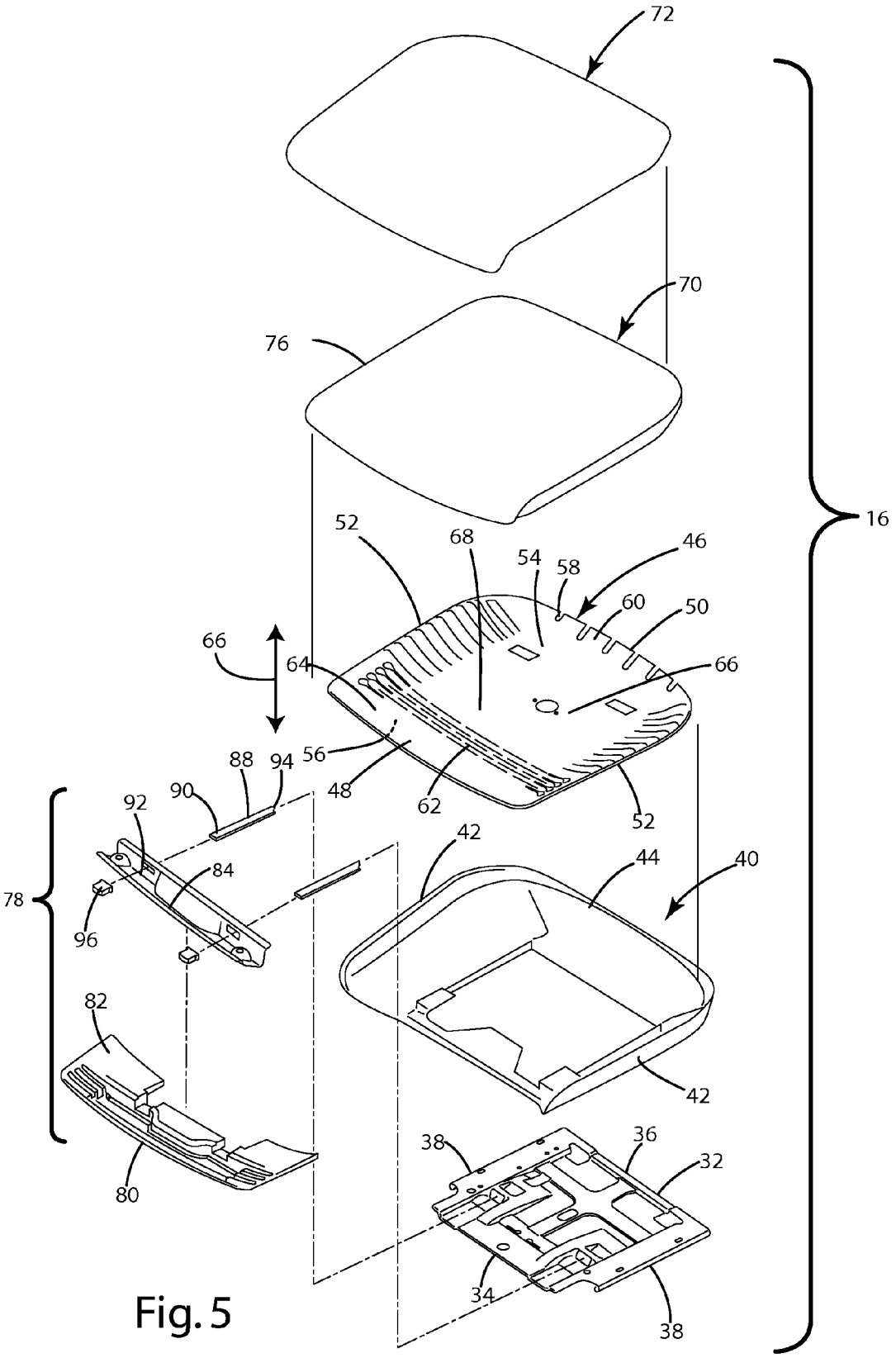
FIG. 5 is an exploded view of the seat assembly.
Figure 6:
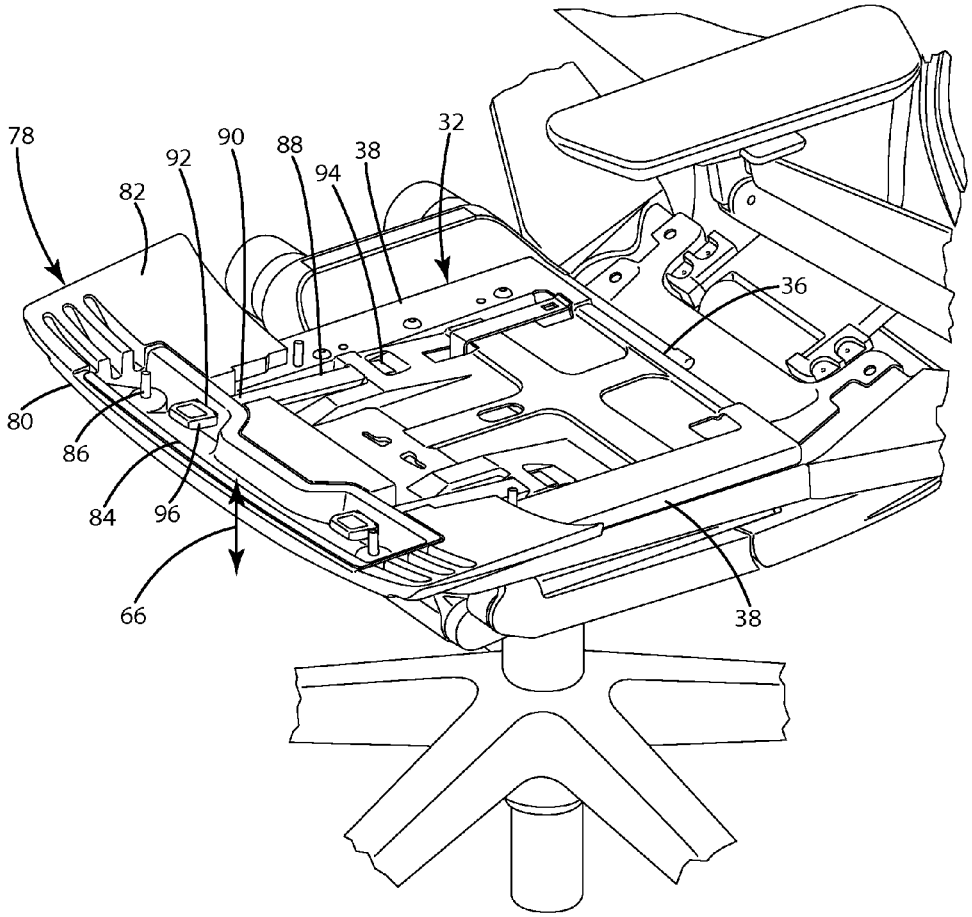
FIG. 6 is an enlarged perspective view of the chair assembly with a portion of the seat assembly removed to illustrate a spring support assembly.
Figure 8:
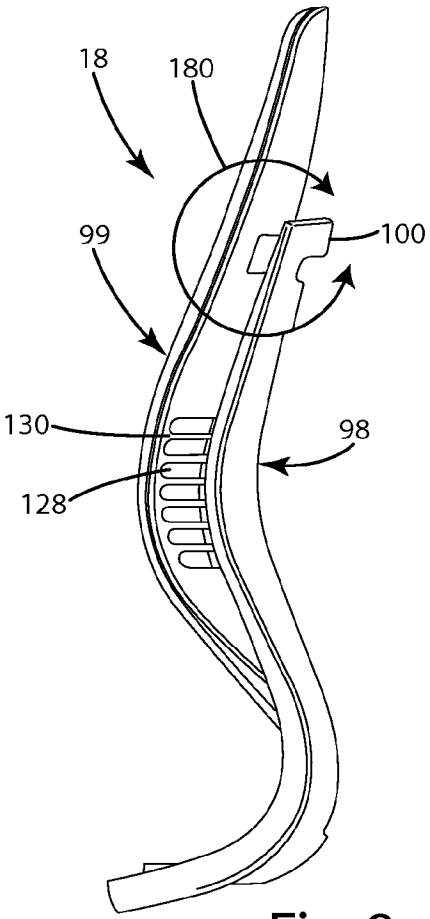
FIG. 8 is a side elevational view of the back assembly.
Figure 7:
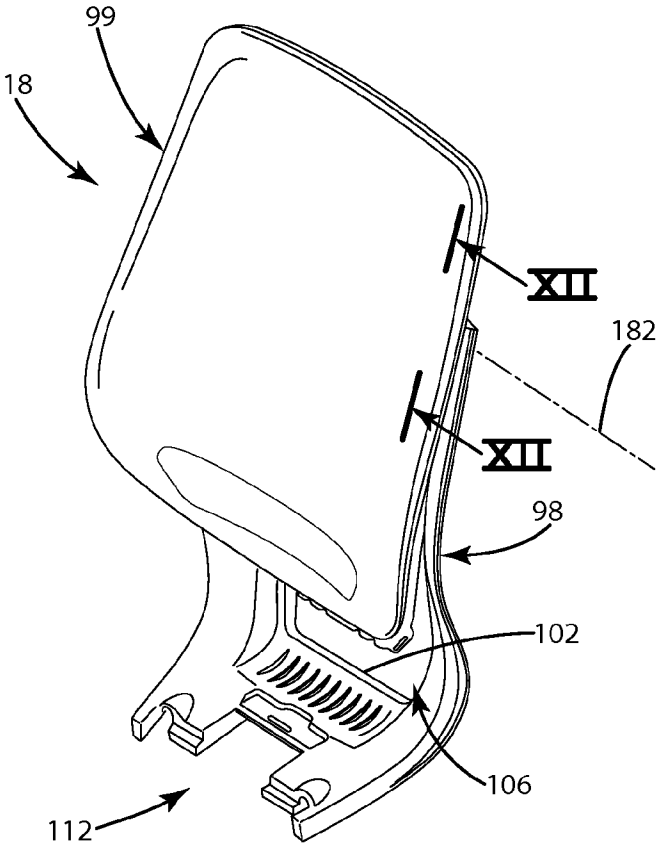
FIG. 7 is a front perspective view of a back assembly.

The seat assembly 16 (FIG. 5) includes a relatively rigid seat support plate 32 having a forward edge 34, a rearward edge 36, and a pair of C-shaped guide rails 38 defining the side edges of the seat support plate 32 and extending between the forward edge 34 and the rearward edge 36. The seat assembly 16 further includes a flexibly resilient outer seat shell 40 having a pair of upwardly turned side portions 42 and an upwardly turned rear portion 44 that cooperate to form an upwardly disposed generally concave shape. In the illustrated example, the seat shell 40 is comprised of a relatively flexible material such as a thermoplastic elastomer (TPE). In assembly, the outer seat shell 40 is secured and sandwiched between the seat support plate 32 and a plastic, flexibly resilient seat pan 46 which is secured to the seat support plate 32 by a plurality of mechanical fasteners. The seat pan 46 includes a forward edge 48, a rearward edge 50, side edges 52 extending between the forward edge 48 and the rearward edge 50, a top surface 54 and a bottom surface 56 that cooperate to form an upwardly disposed generally concave shape. In the illustrated example, the seat pan 46 includes a plurality of longitudinally extending slots 58 extending forwardly from the rearward edge 50. The slots 58 cooperate to define a plurality of fingers 60 therebetween, each finger 60 being individually flexibly resilient. The seat pan 46 further includes a plurality of laterally oriented, elongated apertures 62 located proximate the forward edge 48. The apertures 62 cooperate to increase the overall flexibility of the seat pan 46 in the area thereof, and specifically allow a forward portion 64 of the seat pan 46 to flex in a vertical direction 66 with respect to a rearward portion 68 of the seat pan 46. The seat assembly 16 further includes a foam cushion member 70 that rests upon the top surface 54 of the seat pan 46 and is cradled within the outer seat shell 40, a fabric seat cover 72 (FIGS. 1 and 2) and an upper surface 76 of the cushion members 70. A spring support assembly 78 (FIGS. 5 and 6) is secured to the seat assembly 16 and adapted to flexibly support the forward portion 64 of the seat pan 46 for flexure in the vertical direction 66. In the illustrated example, the spring support assembly 78 includes a support housing 80 comprising a foam and having side portions 82 defining an upwardly concave arcuate shape. The spring support assembly 78 further includes a relatively rigid attachment member 84 that extends laterally between the side portions 82 of the support housing 80 and is located between the support housing 80 and the forward portion 64 of the seat pan 46. A plurality of mechanical fasteners 86 secure the support housing 80 and the attachment member 84 to the forward portion 64 of the seat pan 46. The spring support assembly 78 further includes a pair of cantilever springs 88 each having a distal end 90 received through a corresponding aperture 92 of the attachment member 84, and a proximate end 94 secured to the seat support plate 32 such that the distal end 90 of each cantilever spring 88 may flex in the vertical direction 66. A pair of linear bearings 96 are fixedly attached to the attachment member 84 and aligned with the apertures 92 thereof, such that each linear bearing 96 slidably receives the distal end 90 of a corresponding cantilever spring 88. In operation, the cantilever springs 88 cooperate to allow the forward portion 64 of the seat pan 46, and more generally the entire forward portion of seat assembly 16 to flex in the vertical direction 66 when a seated user rotates forward on the seat assembly 16 and exerts a downward force on the forward edge thereof.

The back assembly 18 (FIGS. 7-9B) includes a back frame assembly 98 and a back support assembly 99 supported thereby. The back frame assembly 98 is generally comprised of a substantially rigid material such as metal, and includes a laterally extending top frame portion 100, a laterally extending bottom frame portion 102, and a pair of curved side frame portion 104 extending between the top frame portion 100 and the bottom frame portion 102 and cooperating therewith to define an opening 106 having a relatively large upper dimension 108 and a relatively narrow lower dimension 110.

The back assembly 18 further includes a flexibly resilient, plastic back shell 112 having an upper portion 114, a lower portion 116, a pair of side edges 118 extending between the upper portion 114 and a lower portion 116, a forwardly facing surface 120 and a rearwardly facing surface 122, wherein the width of the upper portion 114 is generally greater than the width of the lower portion 116, and the lower portion 116 is downwardly tapered to generally follow the rear elevational configuration of the frame assembly 98. A lower reinforcement member 115 attaches to hooks 117 (FIG. 9A) of lower portion 116 of back shell 112. Reinforcement member 115 includes a plurality of protrusions 113 that engage reinforcement rigs 134 to prevent side-to-side movement of lower reinforcement member 115 relative to back shell 112. As discussed below, reinforcement member 115 pivotably interconnects back control link 342 (FIG. 26) to lower portion 116 of back shell 112 at pivot points or axis 346.

Figure 10:
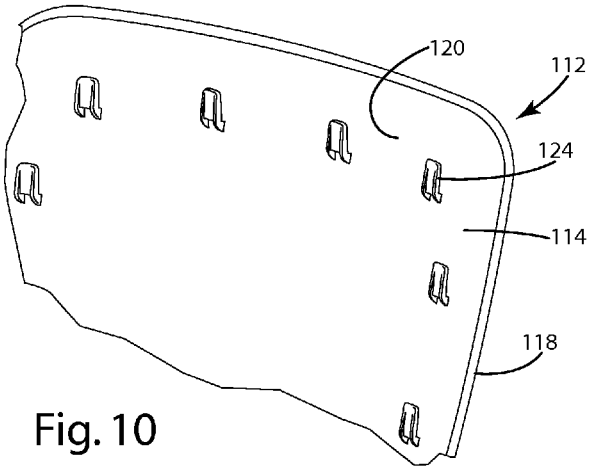
FIG. 10 is an enlarged perspective view of an area X, FIG. 9A.
Figure 11:
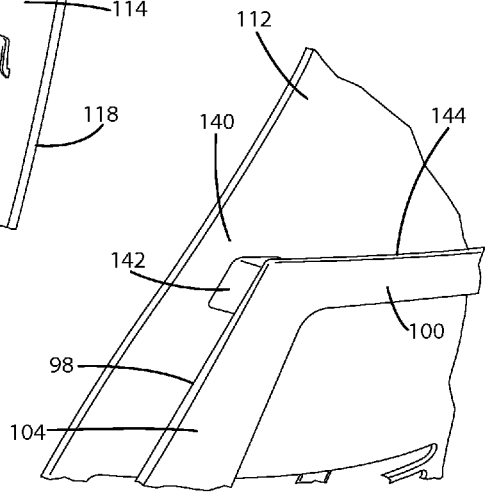
FIG. 11 is an enlarged perspective view of an area XI, FIG. 2.

The back shell 112 also includes a plurality of integrally molded, forwardly and upwardly extending hooks 124 (FIG. 10) spaced about the periphery of the upper portion 114 thereof. An intermediate or lumbar portion 126 is located vertically between the upper portion 114 and the lower portion 116 of the back shell 112, and includes a plurality of laterally extending slots 128 that cooperate to form a plurality of laterally extending ribs 130 located therebetween. The slots 128 cooperate to provide additional flexure to the back shell 112 in the location thereof. Pairings of lateral ribs 130 are coupled by vertically extending ribs 132 integrally formed therewith and located at an approximate lateral midpoint thereof. The vertical ribs 132 function to tie the lateral ribs 130 together and reduce vertical spreading therebetween as the back shell 112 is flexed at the intermediate portion 126 thereof when the back assembly 18 is moved from the upright position E to the reclined position F, as described below. The back shell 112 further includes a plurality of laterally-spaced reinforcement ribs 134 extending longitudinally along the vertical length of the back shell 112 between the lower portion 116 and the intermediate portion 126. It is noted that the depth of each of the ribs 134 increases the further along each of the ribs 134 from the intermediate portion 126, such that the overall rigidity of the back shell 112 increases along the length of the ribs from the intermediate portion 126 toward the lower portion 116.

The back shell 112 further includes a pair of rearwardly extending, integrally molded pivot bosses 138 forming part of an upper back pivot assembly 140. The back pivot assembly 140 (FIGS. 11-13B) includes the pivot bosses 138 of the back shell 112, a pair of shroud members 142 that encompass respective pivot bosses 138, a race member 144, and a mechanical fastening assembly 146. Each pivot boss 138 includes a pair of side walls 148 and a rearwardly-facing concave seating surface 150 having a vertically elongated pivot slot 152 extending therethrough. Each shroud member 142 is shaped so as to closely house the corresponding pivot boss 138, and includes a plurality of side walls 154 corresponding to side walls 148, and a rearwardly-facing concave bearing surface 156 that includes a vertically elongated slot pivot slot 143 extending therethrough, and which is adapted to align with the slot 152 of a corresponding pivot boss 138. The race member 144 includes a center portion 158 extending laterally along and abutting the top frame portion 100 of the back frame assembly 98, and a pair of arcuately-shaped bearing surfaces 160 located at the ends thereof. Specifically, the center portion 158 includes a first portion 162, and a second portion 164, wherein the first portion 162 abuts a front surface of the top frame portion 100 and second portion 164 abuts a top surface of the top frame portion 100. Each bearing surface 160 includes an aperture 166 extending therethrough and which aligns with a corresponding boss member 168 integral with the back frame assembly 98.

In assembly, the shroud members 152 are positioned about the corresponding pivot bosses 138 of the back shell 112 and operably positioned between the back shell 112 and race member 144 such that the bearing surface 156 is sandwiched between the seating surface 150 of a corresponding pivot boss 138 and a bearing surface 160. The mechanical fastening assemblies 146 each include a bolt 172 that secures a rounded abutment surface 174 of the bearing washer 176 in sliding engagement with an inner surface 178 of the corresponding pivot boss 138, and threadably engages the corresponding boss member 168 of the back shell 112. In operation, the upper back pivot assembly 140 allows the back support assembly 99 to pivot with respect to the back frame assembly in a direction 180 (FIG. 8) about a pivot axis 182.

Figure 9A:
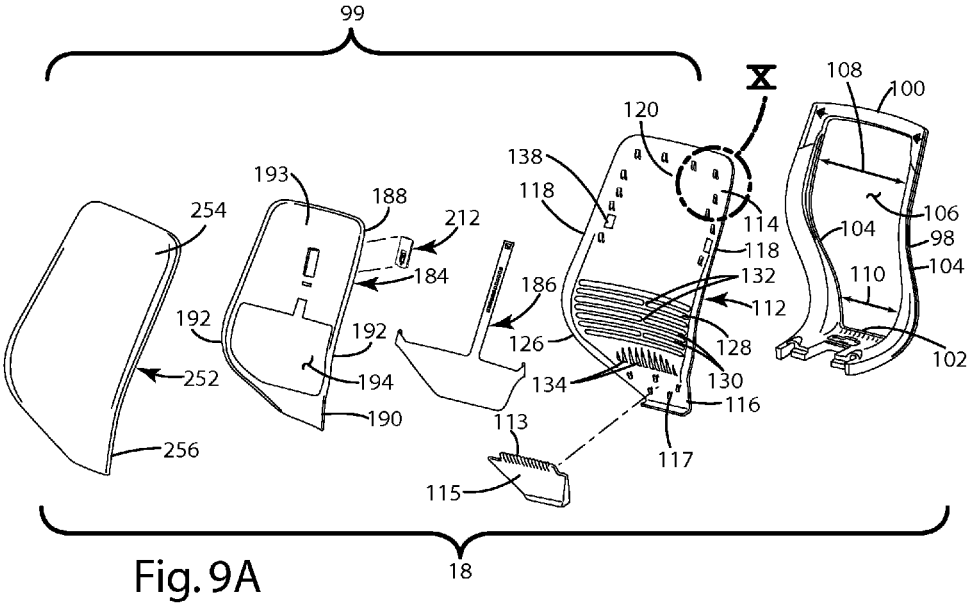
FIG. 9*a* is an exploded front perspective view of the back assembly.
Figure 9B:
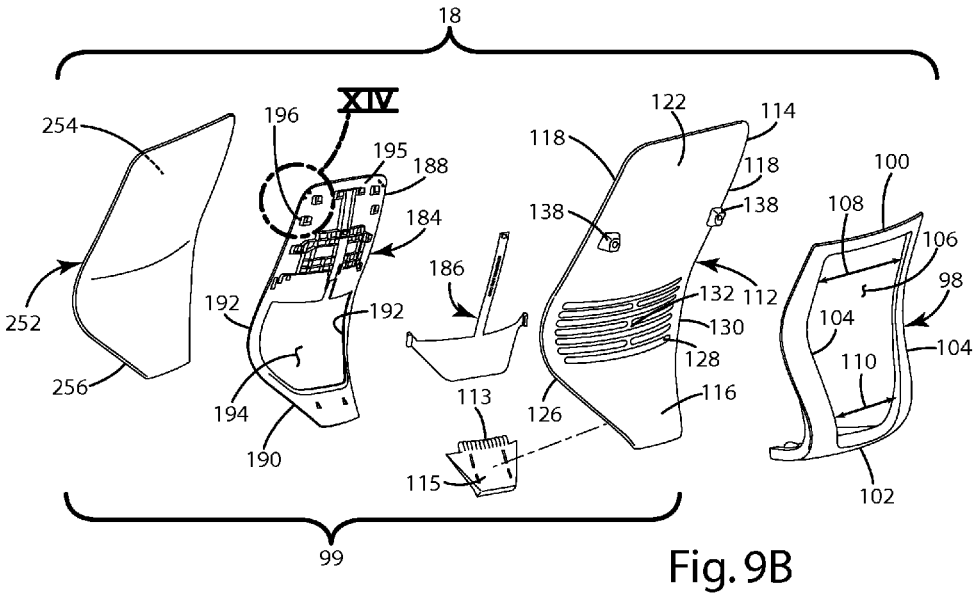
FIG. 9*b* is an exploded rear perspective view of the back assembly.
Figure 12:
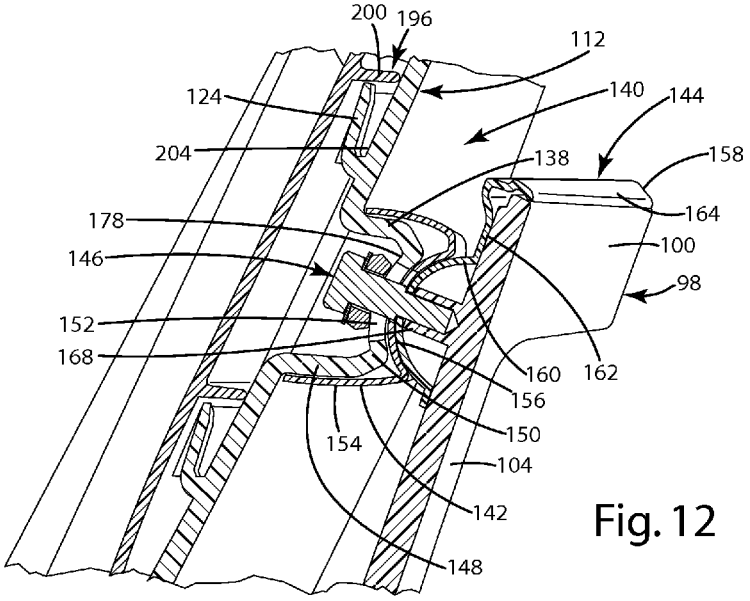
FIG. 12 is a cross-sectional view of an upper back pivot assembly taken along the line XII-XII, FIG. 7.
Figure 13A:
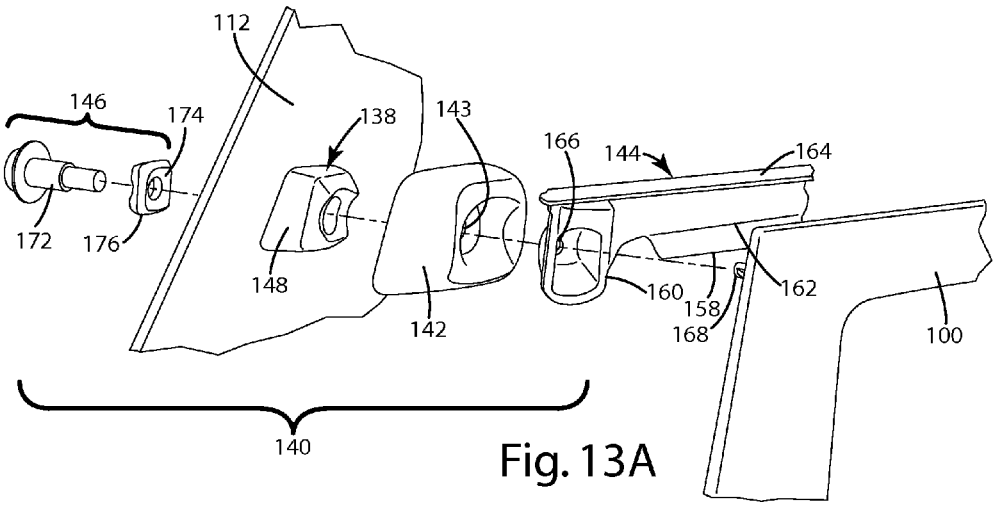
FIG. 13A is an exploded rear perspective view of the upper back pivot assembly.
Figure 13B:
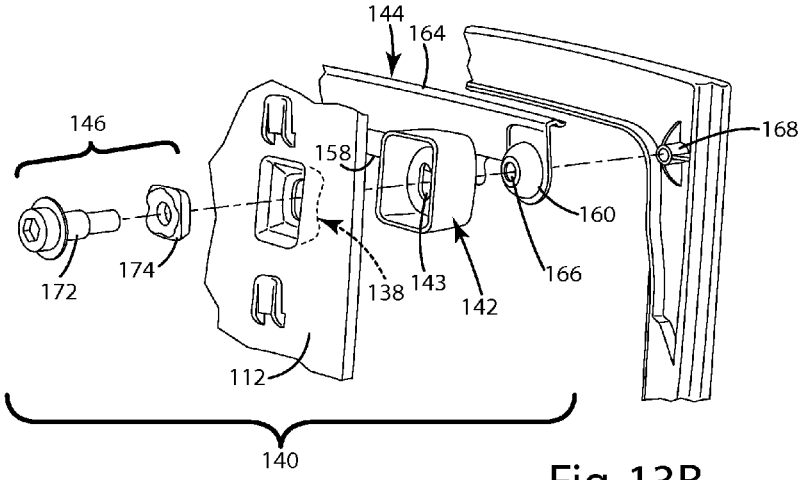
FIG. 13B is an exploded front perspective view of the upper back pivot assembly.
Figure 14:
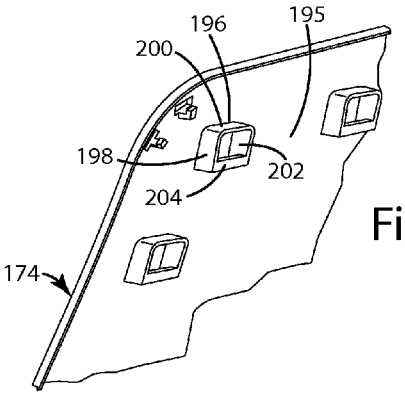
FIG. 14 is an enlarged perspective view of the area XIV, FIG. 9B.
Figure 15A:
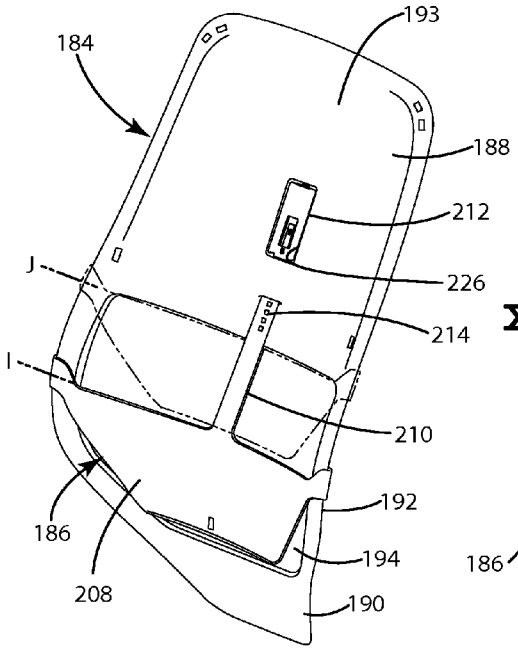
FIG. 15A is a front perspective view of a comfort member and a lumbar assembly.
Figure 15B:
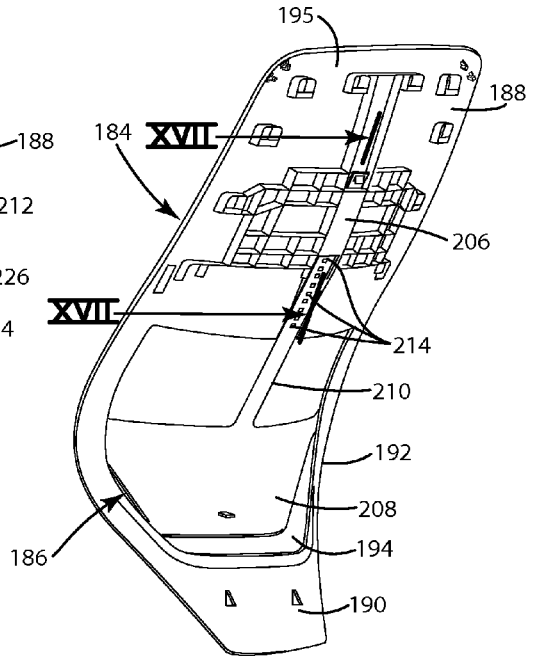
FIG. 15B is a rear perspective view of the comfort member and the lumbar assembly.

The back support assembly 99 (FIGS. 9A and 9B) further includes a flexibly resilient comfort member 184 (FIGS. 15A and 15B) attached to the back shell 112 and slidably supporting a lumbar assembly 186. The comfort member 184 includes an upper portion 188, a lower portion 190, and a pair of side portions 192, a forward surface 193 and a rearward surface 195, wherein the upper portion 188, the lower portion 190 and the slide portions cooperate to form an aperture 194 that receives the lumbar assembly 186 therein. As best illustrated in FIGS. 9B and 14, the comfort member 184 includes a plurality of box-shaped couplers 196 spaced about the periphery of the upper portion 188 and extending rearwardly from the rearward surface 195. Each box-shaped coupler 196 includes a pair of side walls 198 and a top wall 200 that cooperate to form an interior space 202. A bar 204 extends between the side walls 198 and is spaced from the rearward surface 195. In assembly, and as best illustrated in FIG. 12, the comfort member 184 is secured to the back shell 112 by aligning and vertically inserting the hooks 124 of the back shell 112 into the interior space 202 of each of the box-shaped couplers 196 until the hooks 124 engage a corresponding bar 204. It is noted that the forward surface 120 of the back shell 112 and the rearward surface 195 of the comfort member 184 are free from holes or apertures proximate the hooks 124 and box-shaped couplers 196, thereby providing a smooth forward surface 193 and increasing the comfort to a seated user.

Figure 16A:
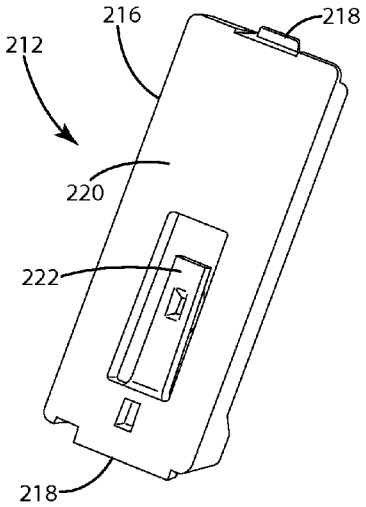
FIG. 16A is a front perspective view of a pawl member.
Figure 16B:
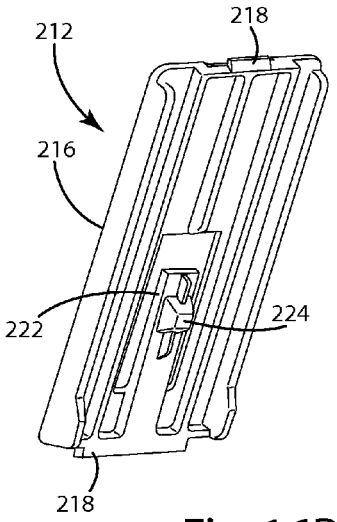
FIG. 16B is a rear perspective view of the pawl member.

The comfort member 184 (FIGS. 15A and 15B) includes an integrally molded, longitudinally extending sleeve 206 extending rearwardly from the rearward surface 195 and having a rectangularly-shaped cross-sectional configuration. The lumbar assembly 186 includes a forwardly laterally concave and forwardly vertically convex, flexibly resilient body portion 208, and an integral support portion 210 extending upwardly from the body portion 208. In the illustrated example, the body portion 208 is shaped such that the body portion vertically tapers along the height thereof so as to generally follow the contours and shape of the aperture 194 of the comfort member 184. The support portion 210 is slidably received within the sleeve 206 of the comfort member 184 such that the lumbar assembly 186 is vertically adjustable with respect to the remainder of the back support assembly 99 between a fully lowered position I and a fully raised position J. A pawl member 212 selectively engages a plurality of apertures 214 spaced along the length of support portion 210, thereby releasably securing the lumbar assembly 186 at selected vertical positions between the fully lowered position I and the fully raised position J. The pawl member 212 (FIGS. 16A and 16B) includes a housing portion 216 having engagement tabs 218 located at the ends thereof and rearwardly offset from an outer surface 220 of the housing portion 216. A flexibly resilient finger 222 is centrally disposed within the housing portion 216 and includes a rearwardly-extending pawl 224.

Figure 17:
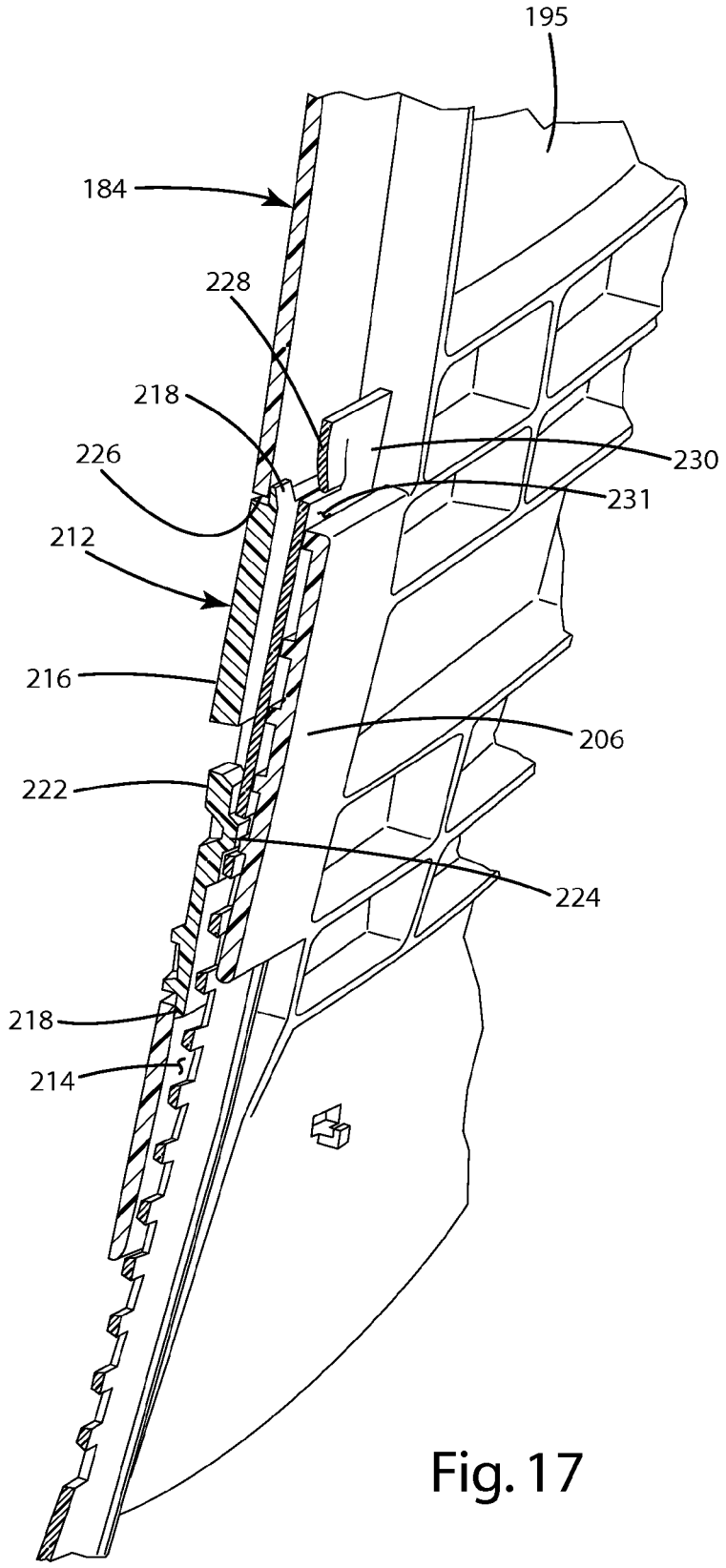
FIG. 17 is a partial cross-sectional perspective view along the line XVIII-XVIII, FIG. 15B.
Figure 18A:
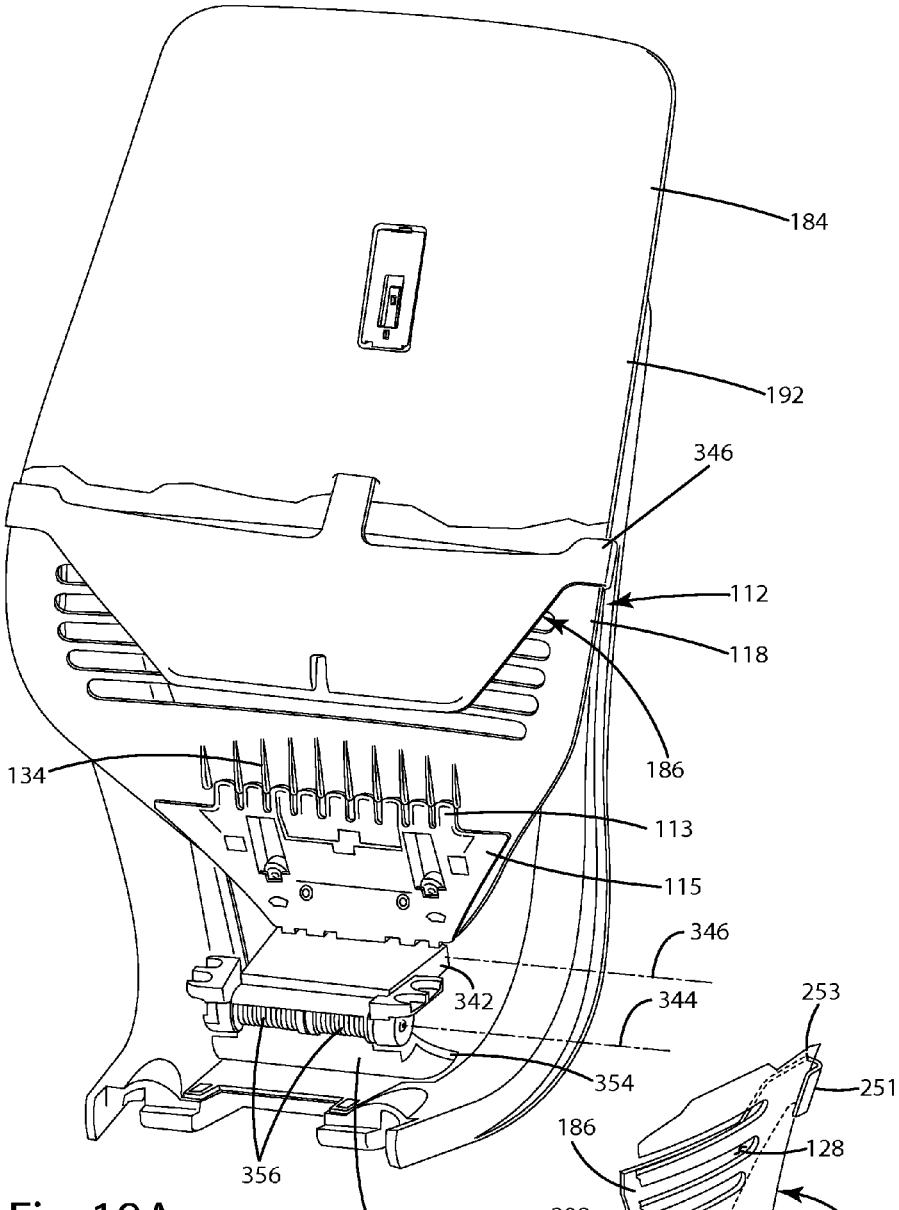
FIG. 18A is a perspective view of the back assembly, wherein a portion of the comfort member is cut away.
Figure 18B:
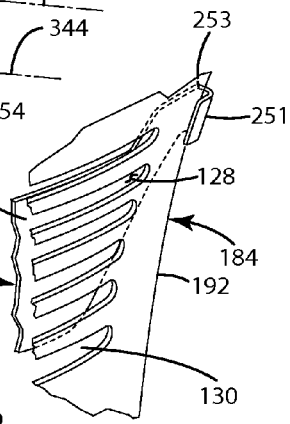
FIG. 18B is an enlarged perspective view of a portion of the back assembly.

In assembly, the pawl member 212 (FIG. 17) is positioned within an aperture 226 located within the upper portion 188 of the comfort member 184 such that the outer surface 220 of the housing portion 216 of the pawl member 212 is coplanar with the forward surface 193 of the comfort member 184, and such that the engagement tabs 218 of the housing portion 216 abut the rearward surface 195 of the comfort member 184. The support portion 210 of the lumbar assembly 186 is then positioned within the sleeve 206 of the comfort member 184 such that the sleeve 206 is slidable therein and the pawl 224 is selectively engageable with the apertures 214, thereby allowing the user to optimize the position of the lumbar assembly 186 with respect to the overall back support assembly 99. Specifically, the body portion 208 of the lumbar assembly 186 includes a pair of outwardly extending integral handle portions 251 (FIGS. 18A and 18B) each having a C-shaped cross-sectional configuration defining a channel 253 therein that wraps about and guides along the respective side edge 192 of the comfort member 184 and the side edge 118 of the back shell 112.

In operation, a user adjusts the relative vertical position of the lumbar assembly 186 with respect to the back shell 112 by grasping one or both of the handle portions 251 and sliding the handle assembly 251 along the comfort member 184 and the back shell 112 in a vertical direction. A stop tab 228 is integrally formed within a distal end 230 and is offset therefrom so as to engage an end wall of the sleeve 206 of the comfort member 184, thereby limiting the vertical downward travel of the support portion 210 of the lumbar assembly 186 with respect to the sleeve 206 of the comfort member 184.

The back assembly 99 (FIGS. 9A and 9B) also includes a cushion member 252 having an upper portion 254 and a lower portion 256, wherein the lower portion 256 tapers along the vertical length thereof to correspond to the overall shape and taper of the back shell 112 and the comfort member 184.

Figure 20:
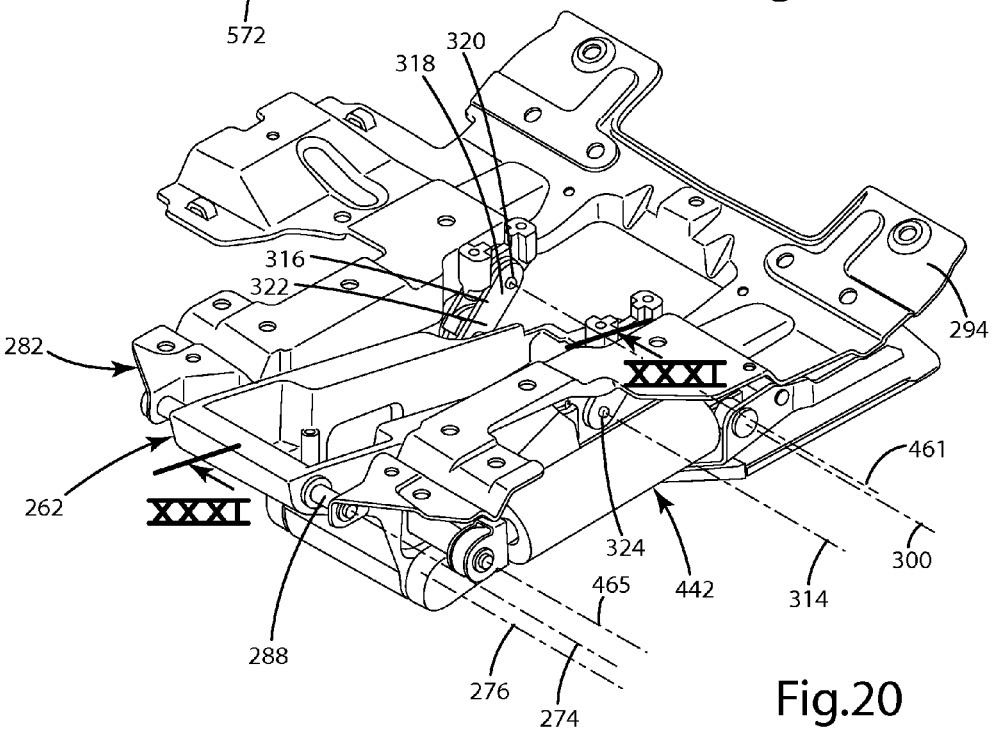
FIG. 20 is a perspective view of the control input assembly with certain elements removed to show the interior thereof.
Figure 21:
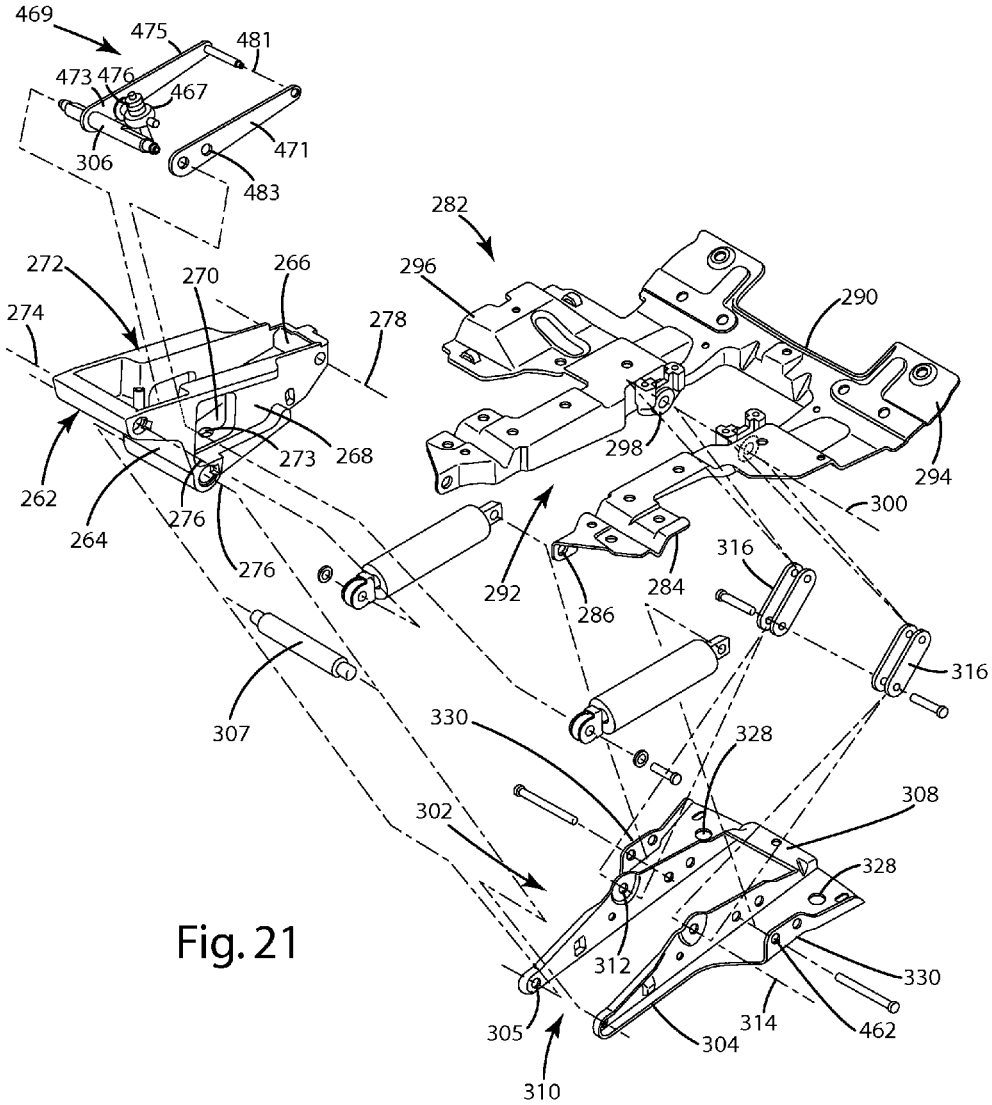
FIG. 21 is an exploded view of the control input assembly.

The seat assembly 16 and the back assembly 18 are operably coupled to and controlled by the control assembly 14 (FIG. 19) and a control input assembly 260. The control assembly 14 (FIGS. 20-22) includes a housing or base structure or ground structure 262 that includes a front wall 264, a rear wall 266, a pair of side walls 268 and a bottom wall 270 integrally formed with one another and that cooperate to form an upwardly opening interior space 272. The bottom wall 270 includes an aperture 273 centrally disposed therein for receiving the cylinder assembly 28 (FIG. 3) therethrough, as described below. The base structure 262 further defines an upper and forward pivot point 274, a lower and forward pivot point 276, and an upper and rearward pivot point 278, wherein the control assembly 14 further includes a seat support structure 282 that supports the seat assembly 16. In the illustrated example, the seat support structure 282 has a generally U-shaped plan form configuration that includes a pair of forwardly extending arm portions 284 each including a forwardly located pivot aperture 286 pivotably secured to the base structure 262 by a pivot shaft 288 for pivoting movement about the upper and forward pivot point 274. The seat support structure 282 further includes a rear portion 290 extending laterally between the arm portions 284 and cooperating therewith to form an interior space 292 within which the base structure 262 is received. The rear portion 290 includes a pair of rearwardly extending arm mounting portions 294 to which the arm assemblies 20 are attached as described below. The seat support structure 282 further includes a control input assembly mounting portion 296 to which the control input assembly 260 is mounted. The seat support structure 282 further includes a pair of bushing assemblies 298 that cooperate to define a pivot point 300.

The control assembly 14 further includes a back support structure 302 having a generally U-shaped plan view configuration and including a pair of forwardly extending arm portions 304 each including a pivot aperture 305 and pivotably coupled to the base structure 262 by a pivot shaft 307 such that the back support structure 302 pivots about the lower and forward pivot point 276. The back support structure 302 includes a rear portion 308 that cooperates with the arm portions 304 to define an interior space 310 which receives the base structure 262 therein. The back support structure 302 further includes a pair of pivot apertures 312 located along the length thereof and cooperating to define a pivot point 314. It is noted that in certain instances, at least a portion of the back frame assembly 98 may be included as part of the back support structure 302.

The control assembly 14 further includes a plurality of control links 316 each having a first end 318 pivotably coupled to the seat support structure 282 by a pair of pivot pins 321 for pivoting about the pivot point 300, and a second end 322 pivotably coupled to corresponding pivot apertures 312 of the back support structure 302 by a pair of pivot pins 324 for pivoting about the pivot point 314. In operation, the control links 316 control the motion, and specifically the recline rate of the seat support structure 282 with respect to the back support structure 302 as the chair assembly is moved to the recline position, as described below.

Figure 23A:
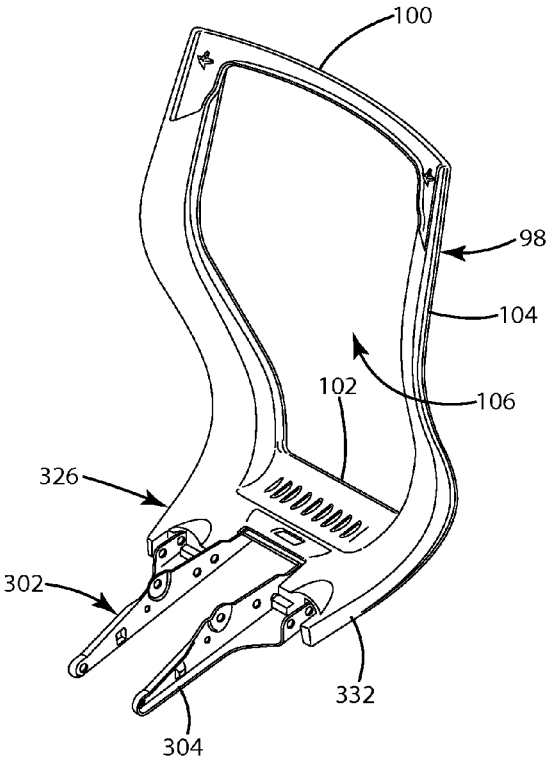
FIG. 23A is a front perspective view of a back support structure.
Figure 23B:
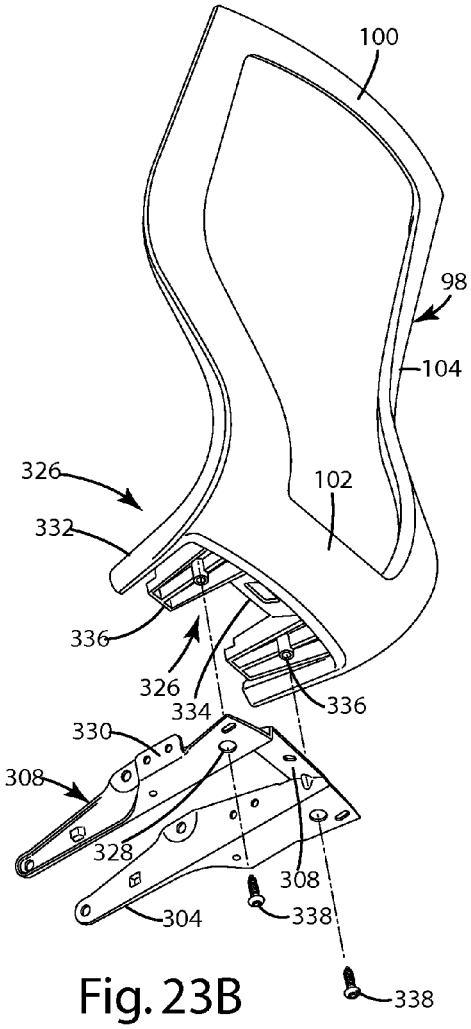
FIG. 23B is an exploded perspective view of the back support structure.

As best illustrated in FIGS. 23A and 23B, a bottom frame portion 102 of the back frame assembly 98 is configured to connect to the back support structure 302 via a quick connect arrangement 326. Each arm portion 304 of the back support structure 302 includes a mounting aperture 328 located at a proximate end 330 thereof. In the illustrated example, the quick connect arrangement 326 includes a configuration of the bottom frame portion 102 of the back frame assembly 98 to include a pair of forwardly-extending coupler portions 332 that cooperate to define a channel 334 therebetween that receives the rear portion 308 and the proximate ends 330 of the arm portions 304 therein. Each coupler portion 332 includes a downwardly extending boss 336 that aligns with and is received within a corresponding aperture 328. Mechanical fasteners, such as screws 338 are then threaded into the bosses 336, thereby allowing a quick connection of the back frame assembly 98 to the control assembly 14.

Figure 24:
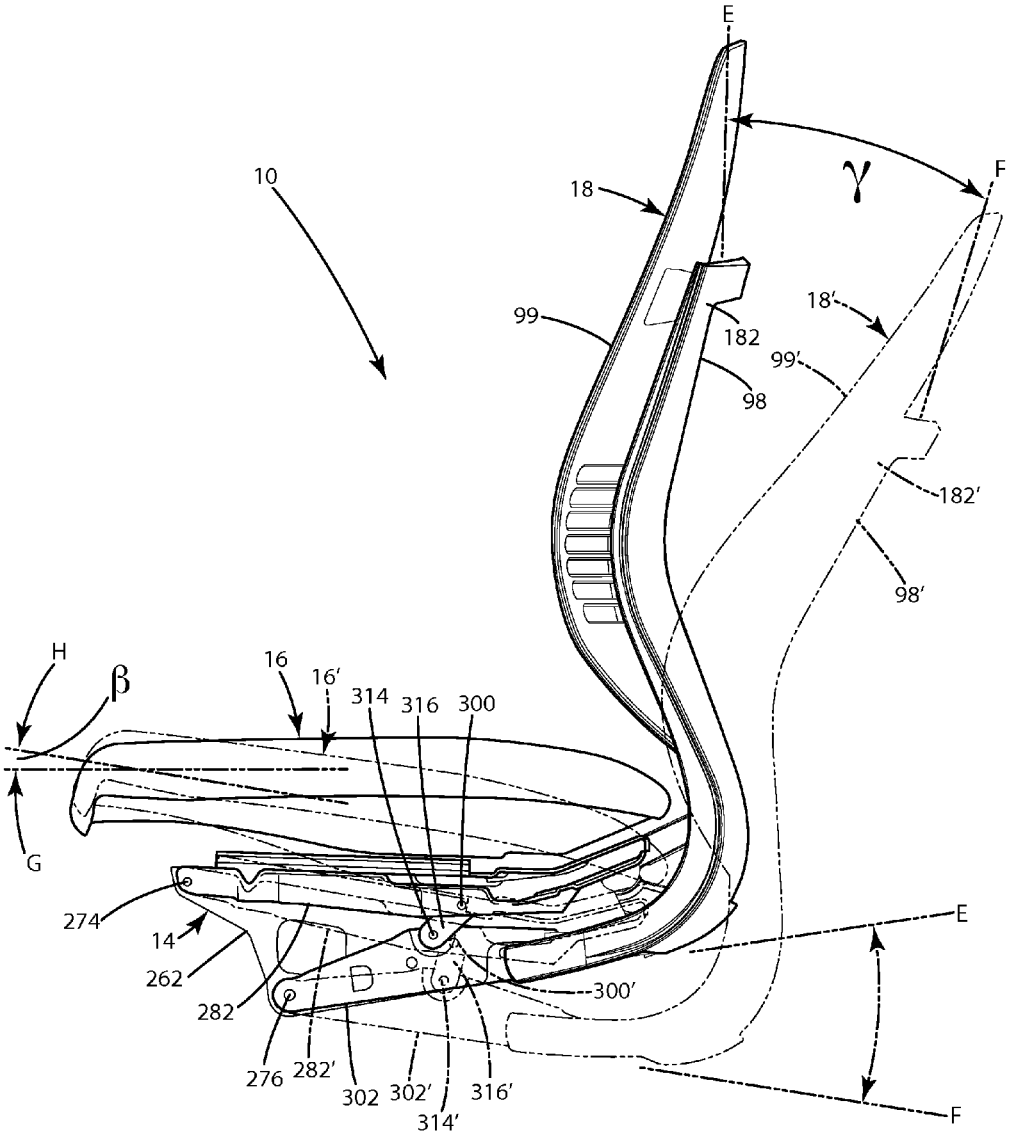
FIG. 24 is a side elevational view of the chair assembly illustrating multiple pivot points thereof.

As best illustrated in FIG. 24, the base structure 262, the seat support structure 282, the back support structure 302 and the control links 316 cooperate to form a 4-bar linkage assembly that supports the seat assembly 16, the back assembly 18, and the arm assemblies 20. For ease of reference, the associated pivot assemblies associated with the 4-bar linkage assembly of the control assembly 14 are referred to as follows: the upper and forward pivot point 274 between the base structure 262 and the base support structure 282 as the first pivot point 274; the lower and forward pivot point 276 between the base structure 262 and the back support structure 302 as the second pivot point 276; the pivot point 300 between the first end 318 of the control link 316 and the seat support structure 282 as the third pivot point 300; and, the pivot point 314 between the second end 322 of the control link 316 and the back support structure 302 as the fourth pivot point 314. Further, FIG. 24 illustrates the component of the chair assembly 10 shown in a reclined position in dashed lines, wherein the reference numerals of the chair in the reclined position are designated with a "'".

In operation, the 4-bar linkage assembly of the control assembly 14 cooperates to recline the seat assembly 16 from the upright position G to the reclined position H as the back assembly 18 is moved from the upright position E to the reclined position F, wherein the upper and lower representations of the positions E and F in FIG. 24 illustrates that the upper and lower portions of the back assembly 18 recline as a single piece. Specifically, the control link 316 is configured and coupled to the seat support structure 282 and the back support structure 302 to cause the seat support structure 282 to rotate about the first pivot point 274 as the back support structure 302 is pivoted about the second pivot point 276. Preferably, the seat support structure 302 is rotated about the first pivot point 279 at between about ⅓ and about ⅔ the rate of rotation of the back support structure 302 about the second pivot point 276, more preferably the seat support structure rotates about the first pivot point 274 at about half the rate of rotation of the back support structure 302 about the second pivot point 276, and most preferable the seat assembly 16 reclines to an angle $\beta$ of about 9° from the fully upright position G to the fully reclined position H, while the back assembly 18 reclines to an angle $\gamma$ of about 18° from the fully upright position E to the fully reclined position F.

Figure 25:
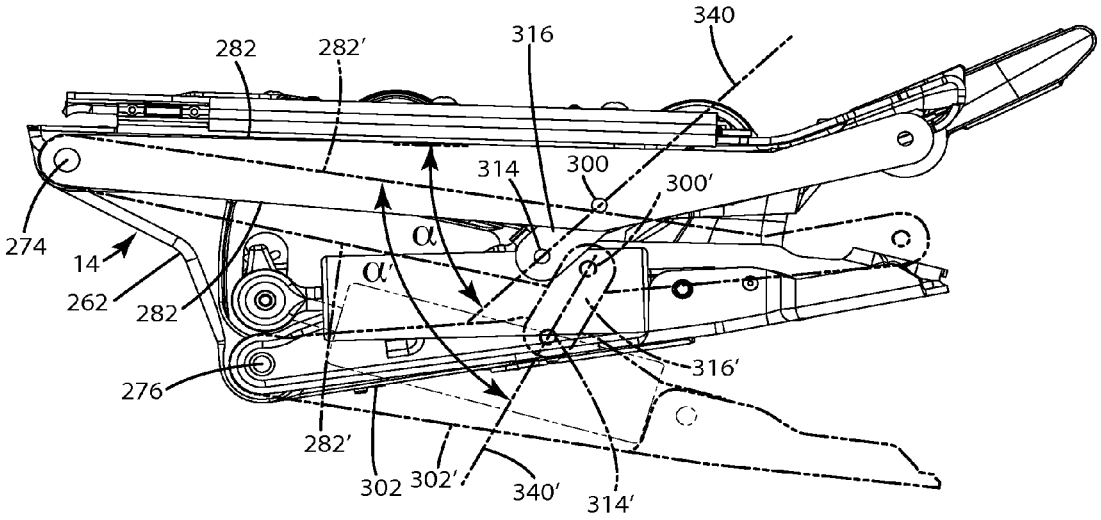
FIG. 25 is a side perspective view of the control assembly showing multiple pivot points associated therewith.

As best illustrated in FIG. 24, the first pivot point 274 is located above and forward of the second pivot point 276 when the chair assembly 10 is at the fully upright position, and when the chair assembly 10 is at the fully reclined position as the base structure 262 remains fixed with respect to the supporting floor surface 13 as the chair assembly 10 is reclined. The third pivot point 300 remains behind and below the relative vertical height of the first pivot point 274 throughout the reclining movement of the chair assembly 10. It is further noted that the distance between the first pivot point 274 and the second pivot point 276 is greater than the distance between the third pivot point 300 and fourth pivot point 314 throughout the reclining movement of the chair assembly 10. As best illustrated in FIG. 25, a longitudinally extending center line axis 340 of the control link 316 forms an acute angle $\alpha$ with the seat support structure 282 when the chair assembly 10 is in the fully upright position and an acute angle $\alpha'$ when the chair assembly 10 is in the fully reclined position. It is noted that the center line axis 340 of the control link 316 does not rotate past an orthogonal alignment with the seat support structure 282 as the chair assembly 10 is moved between the fully upright and fully reclined positions thereof.

Figure 26:
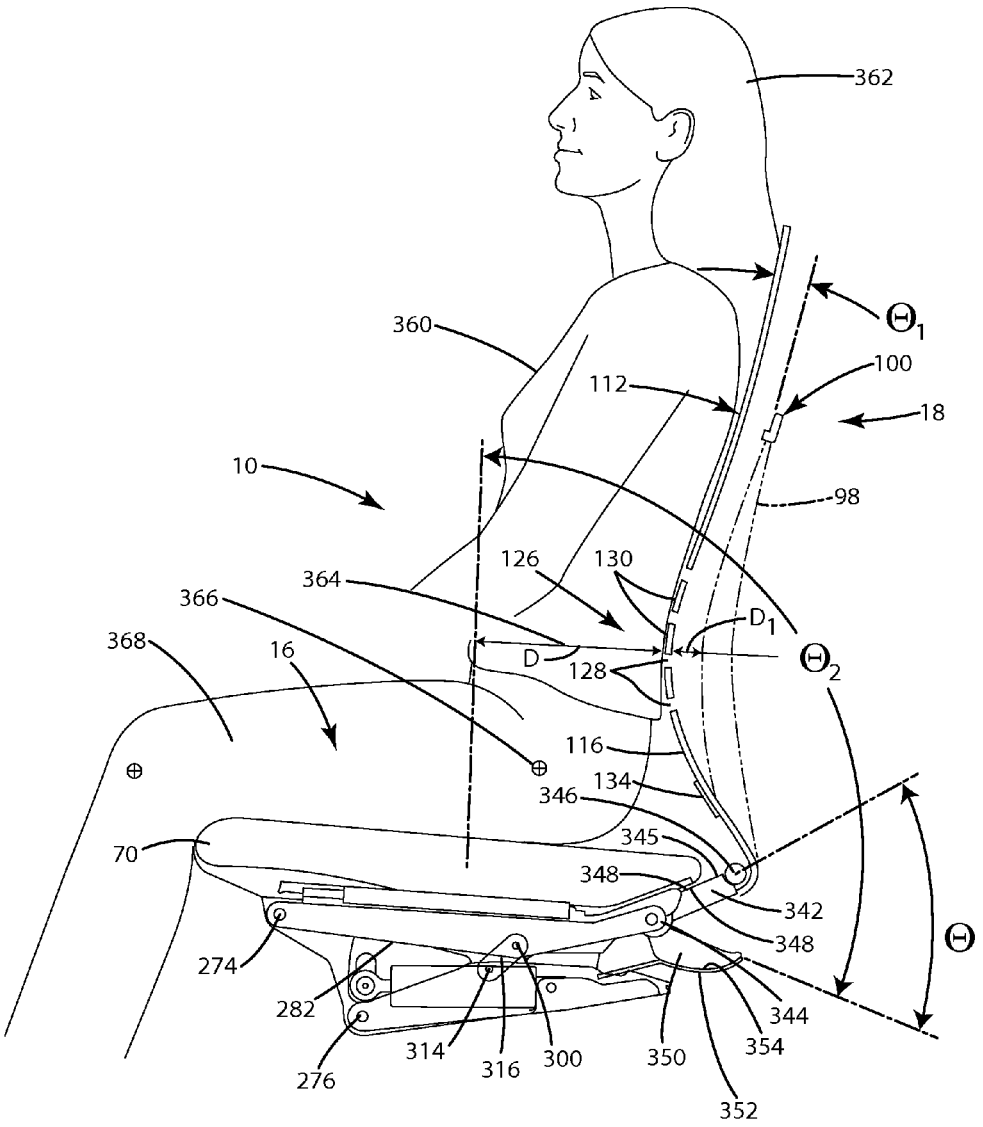
FIG. 26 is a cross-sectional view of the chair showing the back in an upright position with the lumbar adjustment set at a neutral setting.

With further reference to FIG. 26, a back control link 342 includes a forward end that is pivotably connected to seat support structure 282 at a fifth pivot point 344. A rearward end 345 of back control link 342 is connected to lower portion 116 of back shell 112 at a sixth pivot point 346. Sixth pivot point 346 is optional, and back control link 342 and back shell 112 may be rigidly fixed to one another. Also, pivot point 346 may include a stop feature that limits rotation of back control link 342 relative to back shell 112 in a first and/or second rotational direction. For example, with reference to FIG. 26, pivot 346 may include a stop feature that permits clockwise rotation of lower portion 116 of back shell 112 relative to control link 342. This permits the lumbar to become flatter if a rearward/horizontal force tending to reduce dimension D1 is applied to the lumbar portion of back shell 112. However, the stop feature may be configured to prevent rotation of lower portion 116 of back shell 112 in a counter clockwise direction (FIG. 26) relative to control link 342. This causes link 342 and lower portion 116 of back shell 112 to rotate at the same angular rate as a user reclines in the chair by pushing against an upper portion of back assembly 18.

A cam link 350 is also pivotably connected to seat support structure 282 for rotation about pivot point or axis 344. Cam link 350 has a curved lower cam surface 352 that slidably engages an upwardly facing cam surface 354 formed in back support structure 302. A pair of torsion springs 356 (see also FIGS. 18A and 18B) rotatably bias the back control link 342 and the cam link 350 in a manner that tends to increase the angle Ø (FIG. 26). The torsion springs 356 generate a force tending to rotate control link 342 in a counter-clockwise direction (FIG. 26), and simultaneously rotate cam link 350 in a clockwise direction (FIG. 26). Thus, torsion springs 356 tend to increase the angle Ø between back control link 342 and cam link 350. A stop 348 on seat support structure 282 limits counter clockwise rotation of back control link 342 to the position shown in FIG. 26. This force may also bias control link 342 in a counter clockwise direction into the stop feature.

As discussed above, the back shell 112 is flexible, particularly in comparison to the rigid back frame structure 98. As also discussed above, the back frame structure 98 is rigidly connected to the back support structure 302, and therefore pivots with the back support structure 302. The forces generated by torsion springs 356 push upwardly against lower portion 116 of back shell 112. As also discussed above, slots 128 in back shell structure 112 create additional flexibility at lumbar support portion 126 of back shell 112. The force generated by torsion springs 356 also tend to cause the lumbar portion 126 of the back shell 112 to bend forwardly such that the lumbar portion 126 has a higher curvature than the regions adjacent lumbar portion 126.

Figure 27:
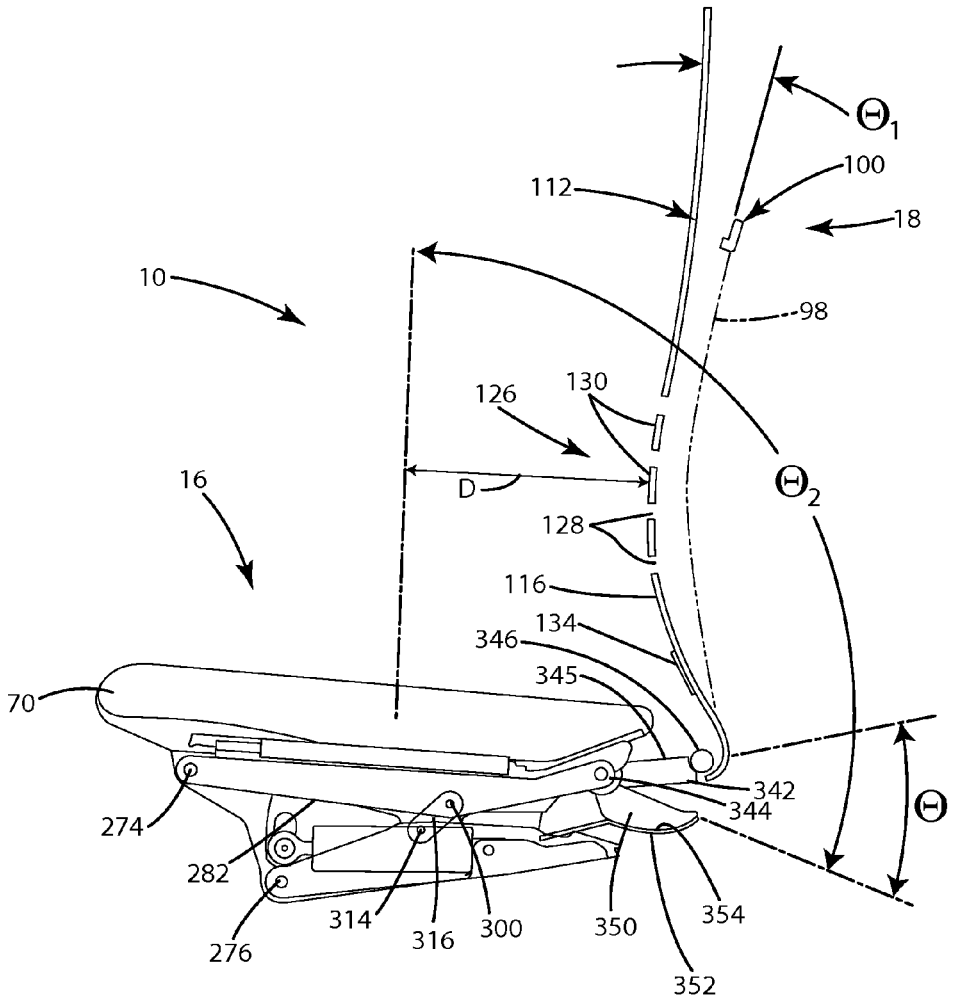
FIG. 27 is a cross-sectional view of the chair showing the back in an upright position with the lumbar portion adjusted to a flat configuration.

As discussed above, the position of lumbar assembly 186 is vertically adjustable. Vertical adjustment of the lumbar assembly also adjusts the way in which the back shell 112 flexes/curves during recline of the chair back. In FIG. 26, the lumbar assembly 186 is adjusted to an intermediate or neutral position, such that the curvature of lumbar portion 126 of back shell 112 is also intermediate or neutral. With further reference to FIG. 27, if the vertical position of the lumbar assembly 186 is adjusted, the angle Ø is reduced, and the curvature of lumbar region 126 is reduced. As shown in FIG. 27, this also causes angle $Ø_1$ to become greater, and the overall shape of the back shell 112 to become relatively flat.

Figure 28:
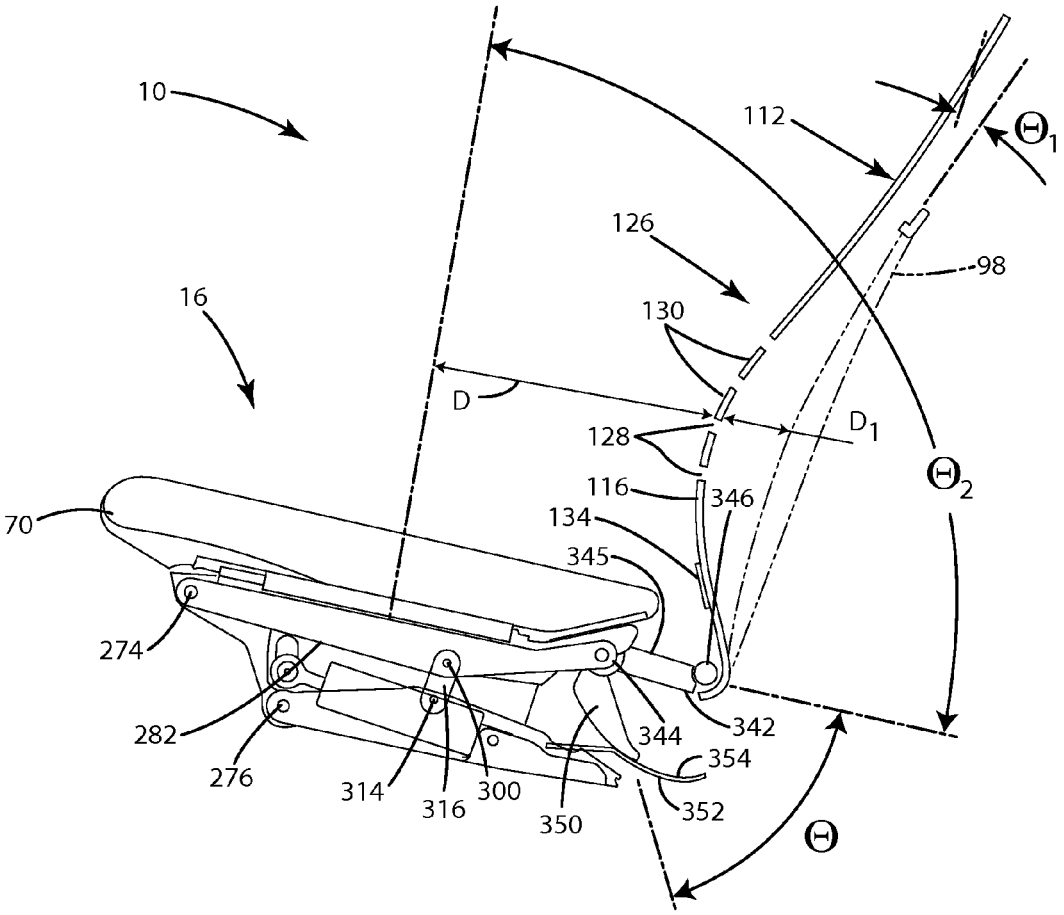
FIG. 28 is a cross-sectional view of the chair showing the back reclined with the lumbar adjusted to a neutral position.

With further reference to FIG. 28, if the height of lumbar assembly 186 is set at an intermediate level (i.e., the same as FIG. 26), and a user leans back, the 4-bar linkage defined by links and structures 262, 282, 302, 316, and pivot points 274, 276, 300, 314 will shift (as described above) from the configuration of FIG. 26 to the configuration of FIG. 28. This, in turn, causes an increase in the distance between pivot point 344 and cam surface 354. This causes an increase in the angle Ø from about 49.5° (FIG. 26) to about 59.9° (FIG. 28). As the spring rotates toward an open position, some of the energy stored in the spring is transferred into the back shell 112, thereby causing the degree of curvature of lumbar portion 116 of back shell 112 to become greater. In this way, back control link 342, cam link 350, and torsion springs 356 provide for greater curvature of lumbar region 116 to reduce curvature of a user's back as the user leans back in the chair.

Also, as the chair tilts from the position of FIG. 26 to the position of FIG. 28, the distance D between the lumbar region 126 and the seat 16 increases from 174 mm to 234 mm. A dimension $D_1$ between the lumbar region 126 of back shell 112 and back frame structure 98 also increases as the back tilts from the position of FIG. 26 to the position of FIG. 28. Thus, although the distance D increases somewhat, the increase in the dimension $D_1$ reduces the increase in dimension D because the lumbar region 126 of back shell 112 is shifted forward relative to the back frame 98 during recline.

Referring again to FIG. 26, a spine 360 of a seated user 362 tends to curve forwardly in the lumbar region 364 by a first amount when a user is seated in an upright position. As a user leans back from the position of FIG. 26 to the position of FIG. 28, the curvature of the lumbar region 364 tends to increase, and the user's spine 360 will also rotate somewhat about hip joint or H-point 366 relative to a user's femur 368. The increase in the dimension D and the increase in curvature of lumbar region 126 of back shell 112 simultaneously ensure that a user's hip joint 366 and femur 368 do not slide on the seat 16, and also accommodate curvature of the lumbar region 364 of a user's spine 360.

Figure 29:
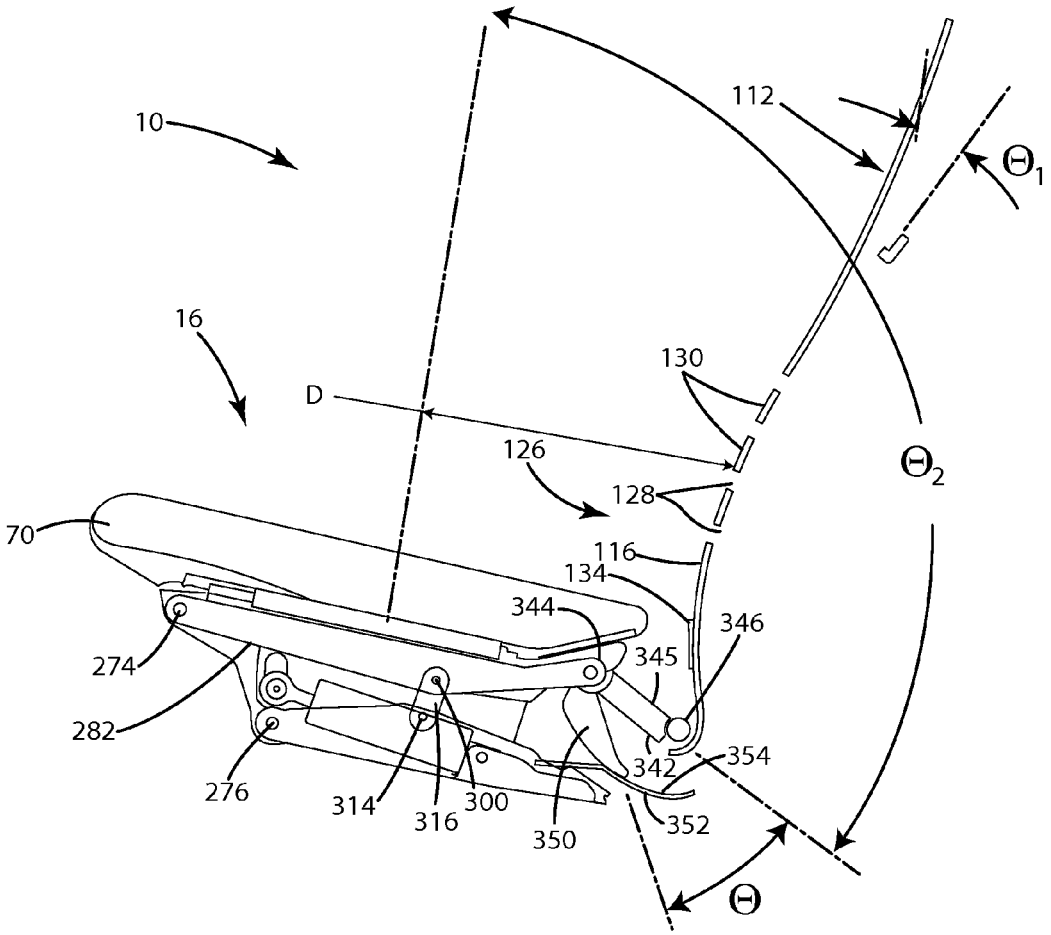
FIG. 29 is a cross-sectional view of the chair in a reclined position with the lumbar adjusted to a flat configuration.

As discussed above, FIG. 27 shows the back of the chair in an upright position with the lumbar region 126 of shell 112 adjusted to a flat position. If the chair back is tilted from the position of FIG. 27 to the position of FIG. 29, the back control link 342 and the cam link 350 both rotate in a clockwise direction. However, the cam link 350 rotates at a somewhat higher rate, and the angle Ø therefore changes from 31.4° to 35.9°. The distance D changes from 202 mm to 265 mm, and the angle $Ø_1$ changes from 24.2° to 24.1°.

Figure 29A:
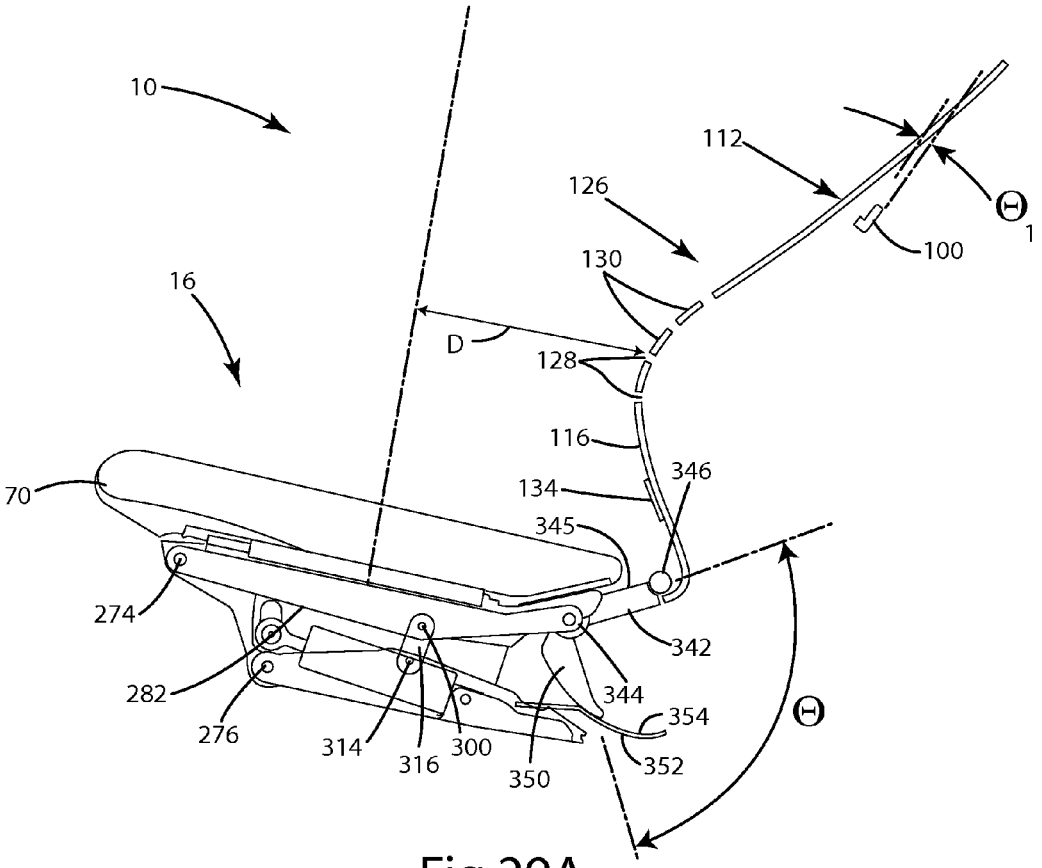
FIG. 29A is a cross-sectional view of the chair showing the back reclined with the lumbar portion of the shell set at a maximum curvature.

With further reference to FIG. 29A, if the chair back is reclined, and the lumbar adjustment is set high, the angle Ø is 93.6°, and the distance D is 202 mm.

Thus, the back shell 112 curves as the seat back is tilted rearwardly. However, the increase in curvature in the lumbar region 126 from the upright to the reclined position is significantly greater if the curvature is initially adjusted to a higher level. This accounts for the fact that the curvature of a user's back does not increase as much when a user reclines if the user's back is initially in a relatively flat condition when seated upright. Restated, if a user's back is relatively straight when in an upright position, the user's back will remain relatively flat even when reclined, even though the degree of curvature will increase somewhat from the upright position to the reclined position. Conversely, if a user's back is curved significantly when in the upright position, the curvature of the lumbar region will increase by a greater degree as the user reclines relative to the increase in curvature if a user's back is initially relatively flat.

Figure 22:
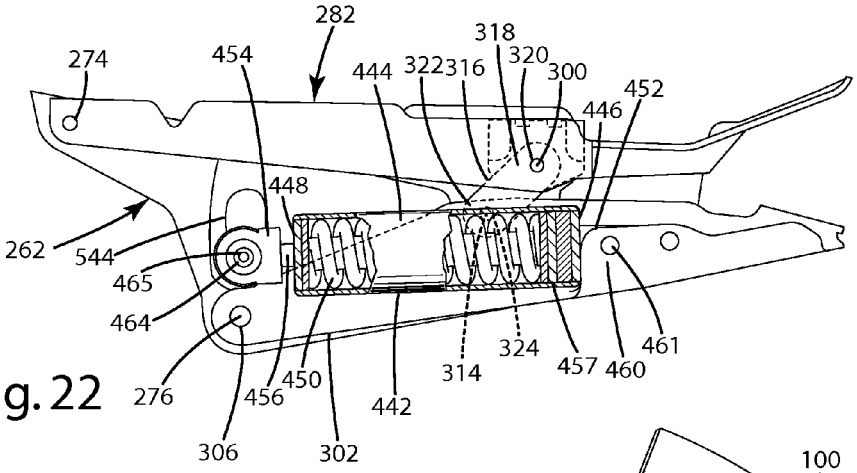
FIG. 22 is a side elevational view of the control input assembly.
Figure 33A:
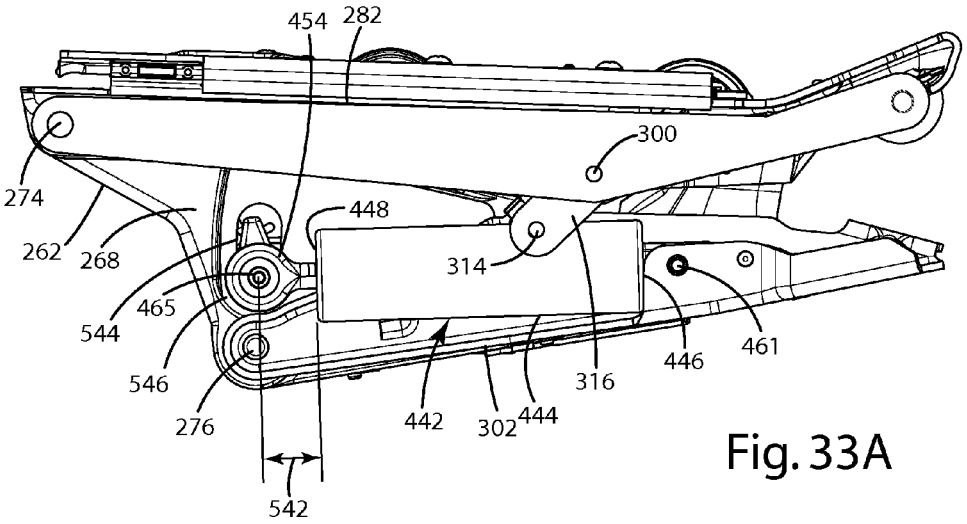
FIG. 33A is a side perspective view of the control assembly with the moment arm shift in a low tension position and the chair assembly in an upright position.
Figure 33B:
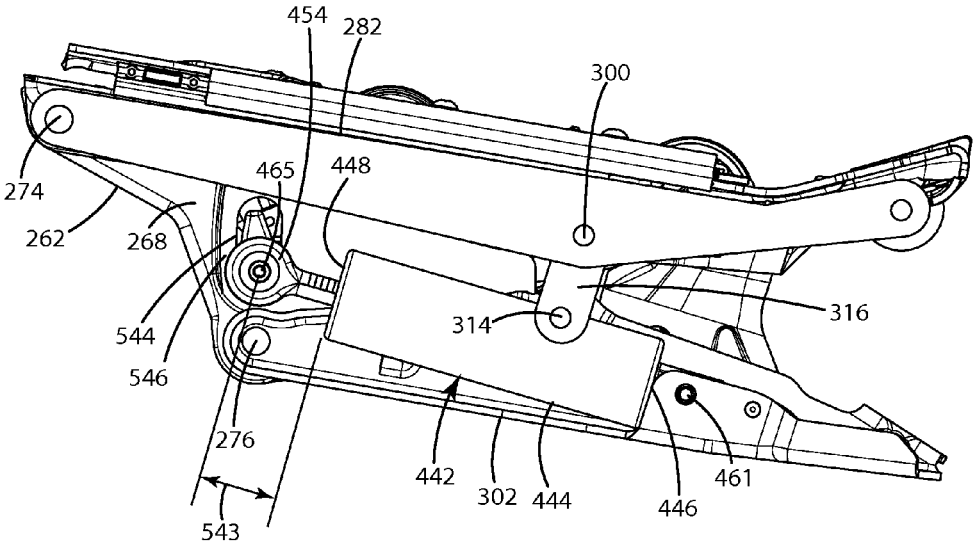
FIG. 33B is a side perspective view of the control assembly with the moment arm shift in a low tension position and the chair assembly in a reclined position.
Figure 34A:
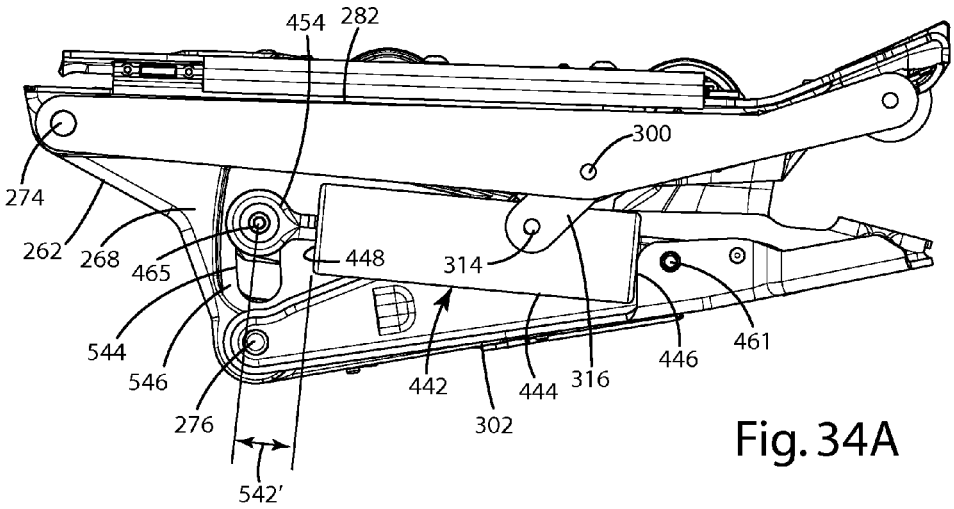
FIG. 34A is a side perspective view of the control assembly with the moment arm shift in a high tension position and the chair assembly in an upright position.
Figure 34B:
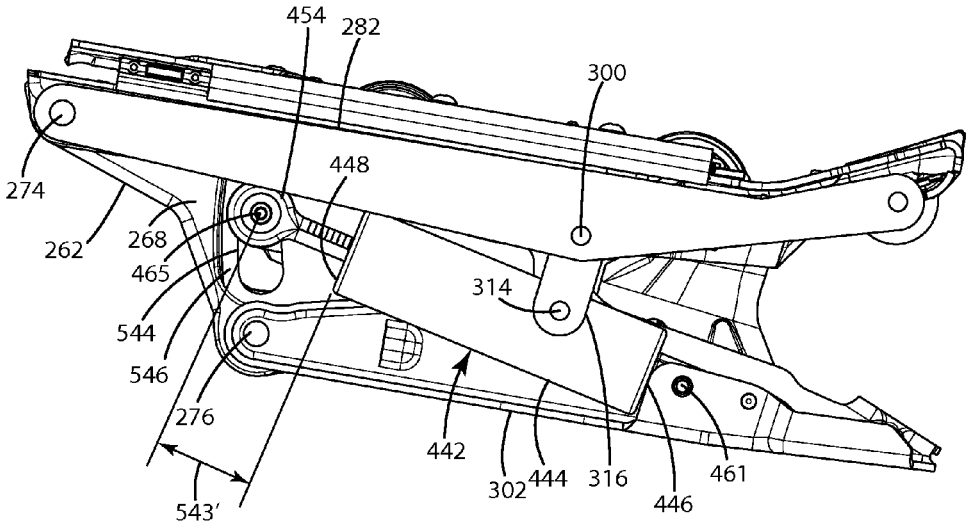
FIG. 34B is a side perspective view of the control assembly with the moment arm shift in a high tension position and the chair assembly in a reclined position.

A pair of spring assemblies 442 (FIGS. 20 and 21) bias the back assembly 18 from the reclined position F towards the upright position E. As best illustrated in FIG. 22, each spring assembly 442 includes a cylindrically-shaped housing 444 having a first end 446 and a second end 448. Each spring assembly 442 further includes a compression coil spring 450, a first coupler 452 and a second coupler 454. In the illustrated example, the first coupler is secured to the first end 446 of the housing 444, while the second coupler 454 is secured to a rod member 456 that extends through the coil spring 450. A washer 457 is secured to a distal end of the rod member 458 and abuts an end of the coil spring 450, while the opposite end of the coil spring 450 abuts the second end 448 of the housing 444. The first coupler 452 is pivotably secured to the back support structure 302 by a pivot pin 460 for pivoting movement about a pivot point 461, wherein the pivot pin 460 is received within pivot apertures 462 of the back support structure 302, while the second coupler 454 is pivotably coupled to a moment arm shift assembly 466 (FIGS. 30-32) by a shaft 464 for pivoting about a pivot point 465. The moment arm shift assembly is adapted to move the biasing or spring assembly 442 from a low tension setting (FIG. 33A) to a high tension setting (FIG. 34A) wherein the force exerted by the biasing assembly 442 on the back assembly 18 is increased relative to the low-tension setting.

Figure 30:
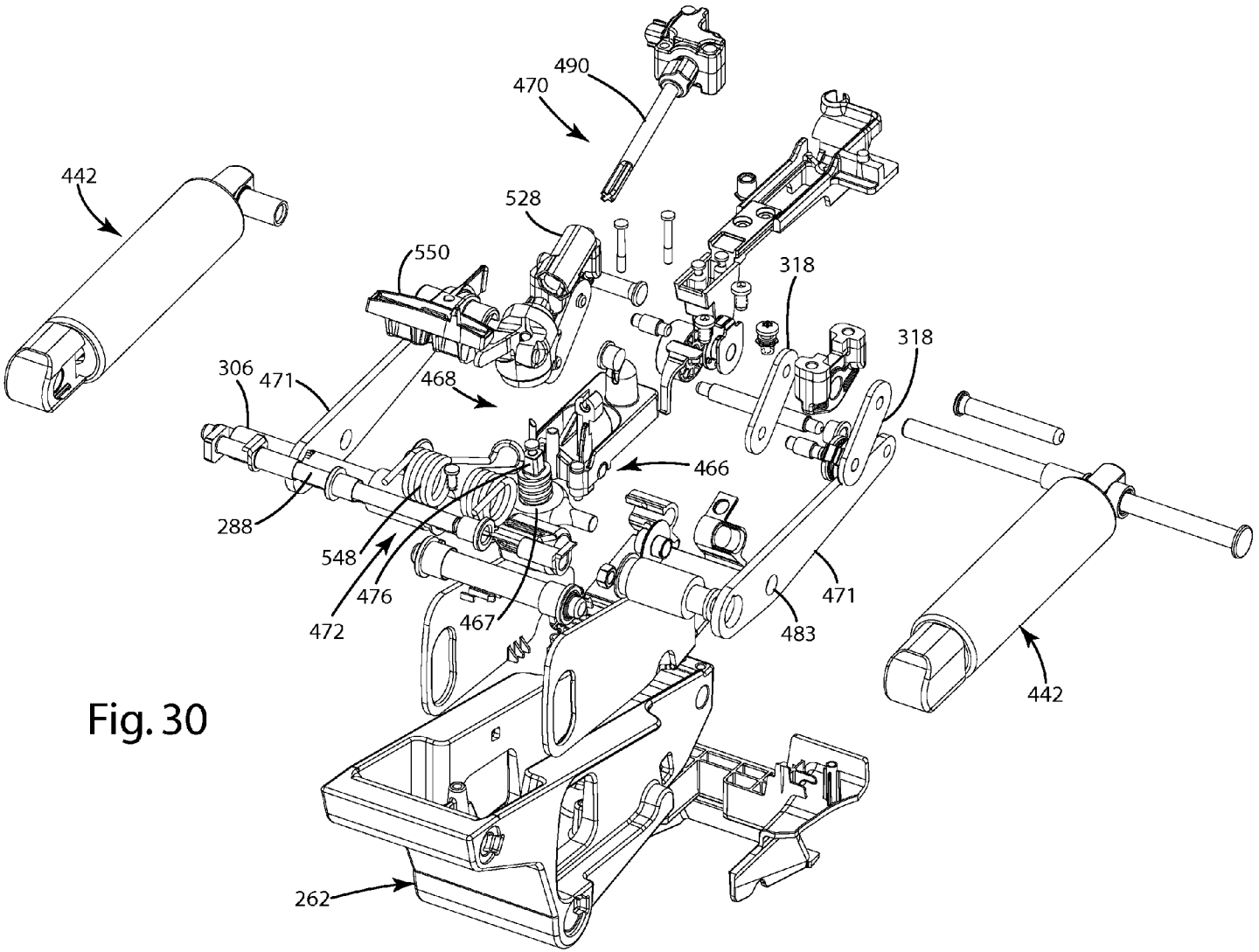
FIG. 30 is an exploded view of a moment arm shift assembly.
Figure 31:
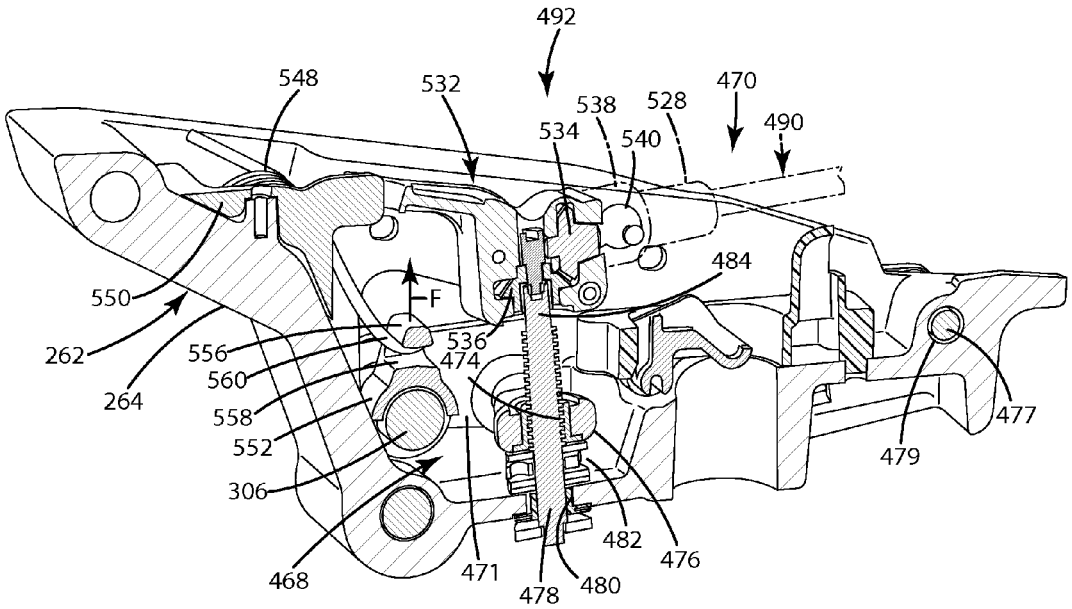
FIG. 31 is a cross-sectional perspective of the moment arm shift assembly.
Figure 32:
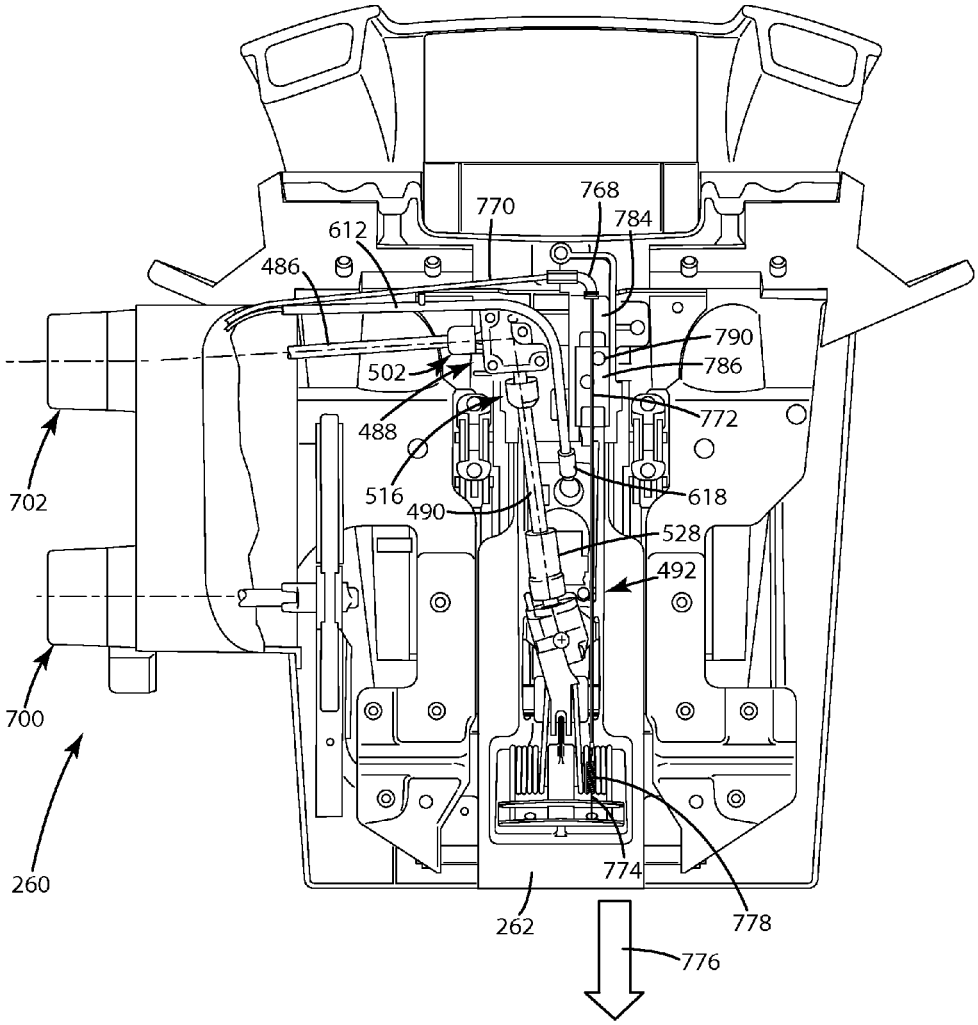
FIG. 32 is a top plan view of a plurality of control linkages.

As illustrated in FIGS. 30-32, the moment arm shift assembly 466 includes an adjustment assembly 468, a moment arm shift linkage assembly 470 operably coupling the control input assembly 260 to the adjustment assembly 468 and allowing the operator to move the biasing assembly 442 between the low and high tension settings, and an adjustment assist assembly 472 that is adapted to reduce the amount of input force required to be exerted by the user on the control input assembly 260 to move the moment arm shift assembly 466 from the low tension setting to the high tension setting, as described below.

The adjustment assembly 468 comprises a pivot pin 467 that includes a threaded aperture that threadably receives a threaded adjustment shaft 476 therein. The adjustment shaft 476 includes a first end 478 and a second end 484, wherein the first end 478 extends through an aperture 480 of the base structure 262 and is guided for pivotal rotation about a longitudinal axis by a bearing assembly 482. The pivot pin 467 is supported from the base structure 262 by a linkage assembly 469 that includes a pair of linkage arms 471 each having a first end 473 pivotably coupled to the second coupler 454 by the pivot pin 464, a second end 475 pivotably coupled to the base structure 262 by a pivot pin 477 pivotably received within a pivot aperture 479 of the base structure 262 for pivoting about a pivot point 481, and an aperture 483 that receives a respective end of the pivot pin 467. The pivot pin 467 is pivotably coupled with the linkage arms 471 along the length thereof.

The moment arm shift linkage assembly 470 includes a first drive shaft extending between the control input assembly 260 and a first beveled gear assembly 488, and a second drive shaft 490 extending between and operably coupling the first beveled gear assembly 488 with a second beveled gear assembly 492, wherein the second beveled gear assembly 492 is connected to the adjustment shaft 476. The first drive shaft 486 includes a first end 496 operably coupled to the control input assembly 260 by a first universal joint assembly 498, while the second end 500 of the first drive shaft 486 is operably coupled to the first beveled gear assembly 488 by a second universal joint assembly 502. In the illustrated example, the first end 496 of the first drive shaft 486 includes a female coupler portion 504 of the first universal joint assembly 498, while the second end 500 of the first drive shaft 486 includes a female coupler portion 506 of the second universal joint assembly 498. The first beveled gear assembly 488 includes a housing assembly 508 that houses a first beveled gear 510 and a second beveled gear 512 therein. As illustrated, the first beveled gear 510 includes an integral male coupler portion 514 of the second universal joint 502. The first end 496 of the second drive shaft 490 is coupled to the first beveled gear assembly 488 by a third universal joint assembly 516. A first end 518 of the second drive shaft 490 includes a female coupler portion 520 of the third universal joint assembly 516. The second beveled gear 512 includes an integral male coupler portion 522 of the third universal joint assembly 516. A second end 524 of the second drive shaft 490 includes a plurality of longitudinally extending splines that mate with corresponding longitudinally extending splines (not shown) of a coupler member 528. The coupler member 528 couples the second end 524 of the second drive shaft 490 with the second beveled gear assembly 492 via a fourth universal joint assembly 530. The fourth universal joint assembly 530 includes a housing assembly 532 that houses a first beveled gear 534 coupled to the coupler member 528 via the fourth universal joint assembly 530, and a second beveled gear 536 fixed to the second end 484 of the adjustment shaft 476. The coupler member 428 includes a female coupler portion that receives a male coupler portion 540 integral with the first beveled gear 534.

In assembly, the adjustment assembly 468 of the moment arm shift assembly 466 is operably supported by the base structure 262, while the control input assembly 260 is operably supported by the control input assembly mounting portion 296 of the seat support structure 282. As a result, the relative angles and distances between the control input assembly 260 and the adjustment assembly 468 of the moment arm shift assembly 466 change as the seat support structure 282 is moved between the fully upright position G and the fully reclined H. The third and fourth universal joint assemblies 516, 530, and the spline assembly between splines 526 and splines 528 cooperate to compensate for these relative changes in angle and distance.

As is best illustrated in FIGS. 33A-34B, the moment arm shift assembly 466 functions to adjust the biasing assemblies 442 between the low-tension and high-tension settings. Specifically, the biasing assemblies 442 are shown in a low-tension setting with the chair assembly 10 in an upright position in FIG. 33A and the low-tension setting with the chair assembly 10 in a reclined position in FIG. 33B, while FIG. 34A illustrates the biasing assemblies 442 in the high-tension setting with the chair in an upright position, and FIG. 34B the biasing assemblies in the high-tension setting with the chair assembly 10 in the reclined position. The distance 542, as measured between the pivot point 465 and the second end 448 of the housing 444 of the spring assembly 442, serves as a reference to the amount of compression exerted on the spring assembly 442 when the moment arm shift assembly 466 is positioned in the low-tension setting and the chair is in the upright position. The distance 542 (FIG. 34A) comparatively illustrates the increased amount of compressive force exerted on the spring assembly 442 when the moment arm shift assembly 466 is in the high-tension setting and the chair is in the upright position. The user adjusts the amount of force exerted by the biasing assemblies 442 on the back support structure 302 by moving the moment arm shift assembly 466 from the low-tension setting to the high-tension setting. Specifically, the operator, through an input to the control input assembly 260, drives the adjustment shaft 476 of the adjustment assembly 468 in rotation via the moment arm shift linkage assembly 470, thereby causing the pivot shaft 467 to travel along the length of the adjustment shaft 476, thus changing the compressive force exerted on the spring assemblies 442 as the pivot shaft 465 is adjusted with respect to the base structure 262. The pivot shaft 467 travels within a slot 544 located within a side plate member 546 attached to a side wall 268 of the base structure 262. It is noted that the distance 542 when the moment arm shift assembly 466 is in the high-tension setting and the chair assembly 10 is in the upright position is greater than the distance 542 when the moment arm shift 466 is in the low-tension setting and the chair is in the upright position, thereby indicating that the compressive force as exerted on the spring assemblies 442, is greater when the moment arm shift is in the high-tension setting as compared to a low-tension setting. Similarly, the distance 543 (FIG. 33B) is greater than the distance 543 (FIG. 34B), resulting in an increase in the biasing force exerted by the biasing assemblies 442 and forcing the back assembly 18 from the reclined position towards the upright position. It is noted that the change in the biasing force exerted by the biasing assemblies 442 corresponds to a change in the biasing torque exerted about the second pivot point 276, and that in certain configurations, a change in the biasing torque is possible without a change in the length of the biasing assemblies 442 or a change in the biasing force.

Figure 35:
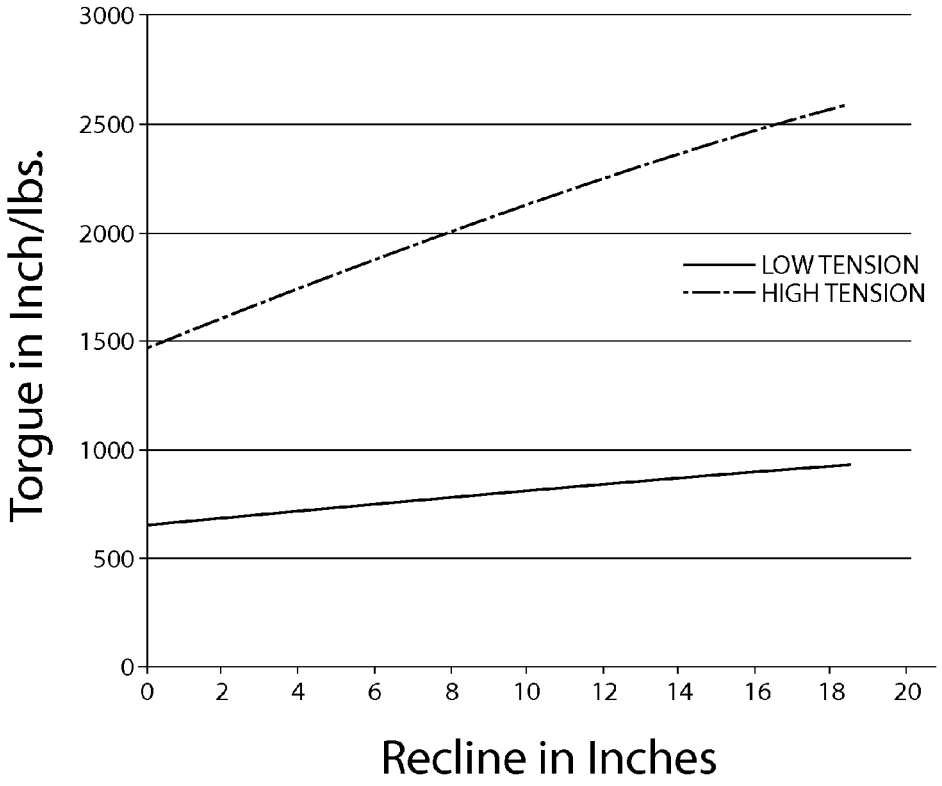
FIG. 35 is a chart of torque vs. amount of recline for low and high tension settings.

FIG. 35 is a graph of the amount of torque exerted about the second pivot point 276 forcing the back support structure 302 from the reclined position towards the upright position as the back support structure 302 is moved between the reclined and upright positions. In the illustrated example, the biasing assemblies 442 exert a torque about the second pivot point 276 of about 652 inch-pounds when the back support structure is in the upright position and the moment arm shift 466 is in the low tension setting, and of about 933 inch-pounds when the back support structure is in the reclined position and the moment arm shift 466 is in the low tension setting, resulting in a change of approximately 43%. Likewise, the biasing assemblies 442 exert a torque about the second pivot point 274 of about 1.47 E+03 inch-pounds when the back support structure is in the upright position and the moment arm shift 466 is in the high tension setting, and of about 2.58 E+03 inch-pounds when the back support structure is in the reclined position and the moment arm shift 466 is in the high tension setting, resulting in a change of approximately 75%. This significant change in the amount of torque exerted by the biasing assembly 442 between the low tension setting and the high tension setting of the moment arm shift 466 as the back support structure 302 is moved between the upright and reclined positions allows the overall chair assembly 10 to provide proper forward back support to users of varying height and weight.

The adjustment assist assembly 472 assists an operator in moving the moment arm shift assembly 466 from the high-tension setting to the low-tension setting. The adjustment assist assembly 472 includes a coil spring 548 secured to the front wall 264 of the base structure 262 by a mounting structure 550, and a catch member 552 that extends about the shaft 306 fixed with the linkage arms 471, and that includes a catch portion 556 defining an aperture 558 that catches a free end 560 of the coil spring 548. The coil spring 548 exerts a force F on the catch member 552 and shaft 306 in an upward vertical direction, and on the shaft 306 that is attached to the linkage arms 471, thereby reducing the amount of input force the user must exert on the control input assembly 260 to move the moment arm shift assembly 466 from the low-tension setting to the high-tension setting.

Figure 3:
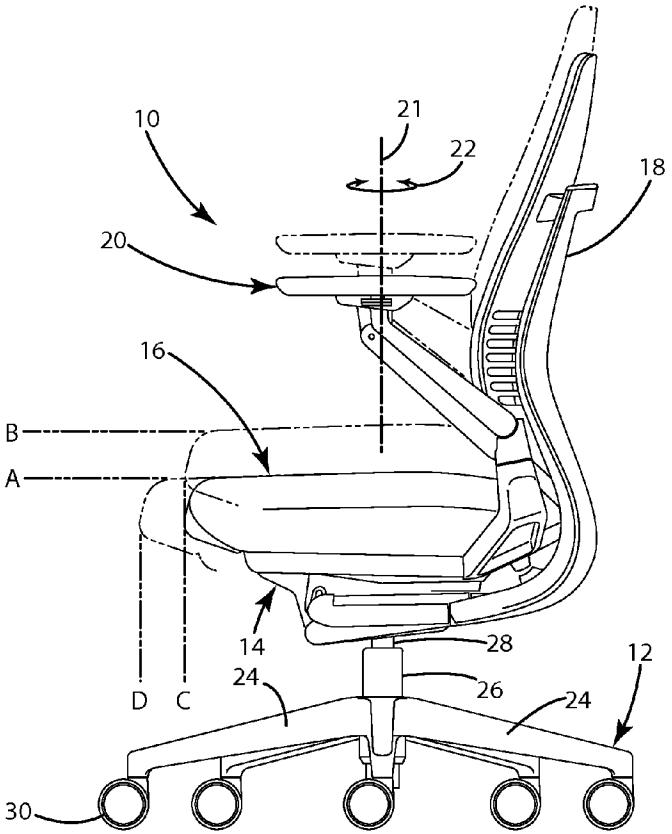
FIG. 3 is a side elevational view of the chair assembly showing the chair assembly in a lowered position and in a raised position in dashed line, and a seat assembly in a retracted position and an extended position in dashed line.
Figure 19:
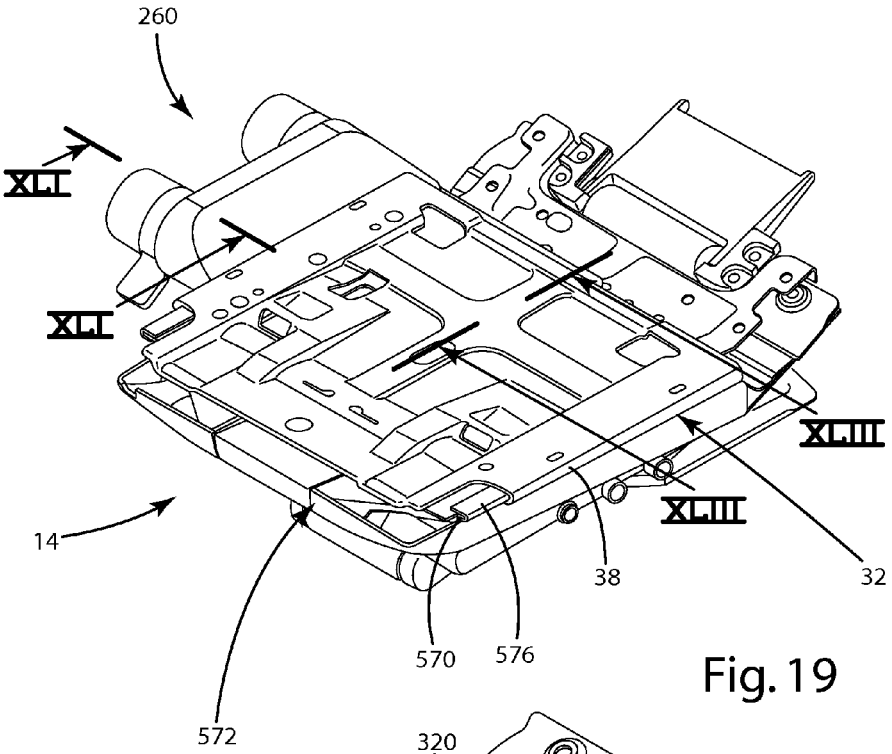
FIG. 19 is a perspective view of a control input assembly supporting a seat support plate thereon.
Figure 36:
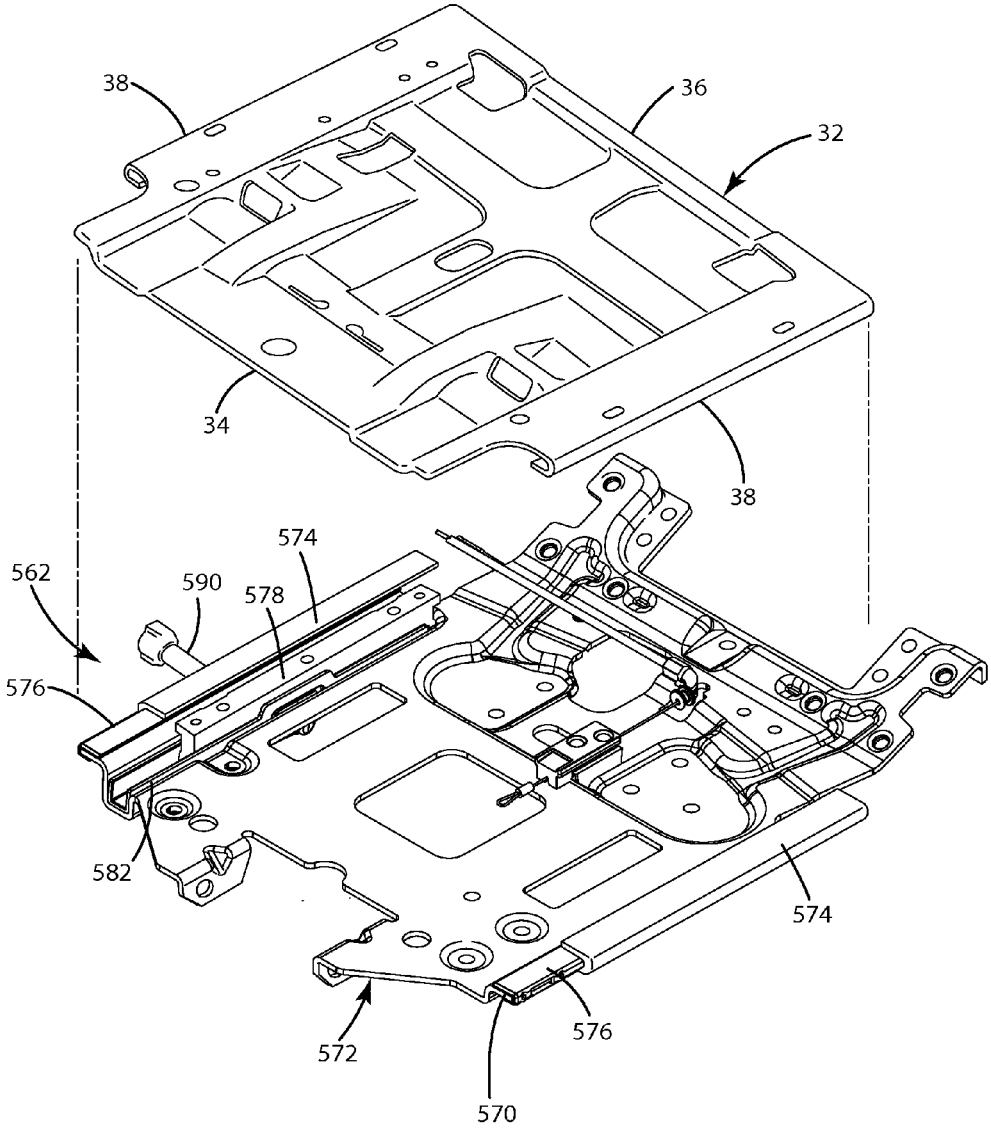
FIG. 36 is a perspective view of a direct drive assembly with the seat support plate exploded therefrom.
Figure 37:
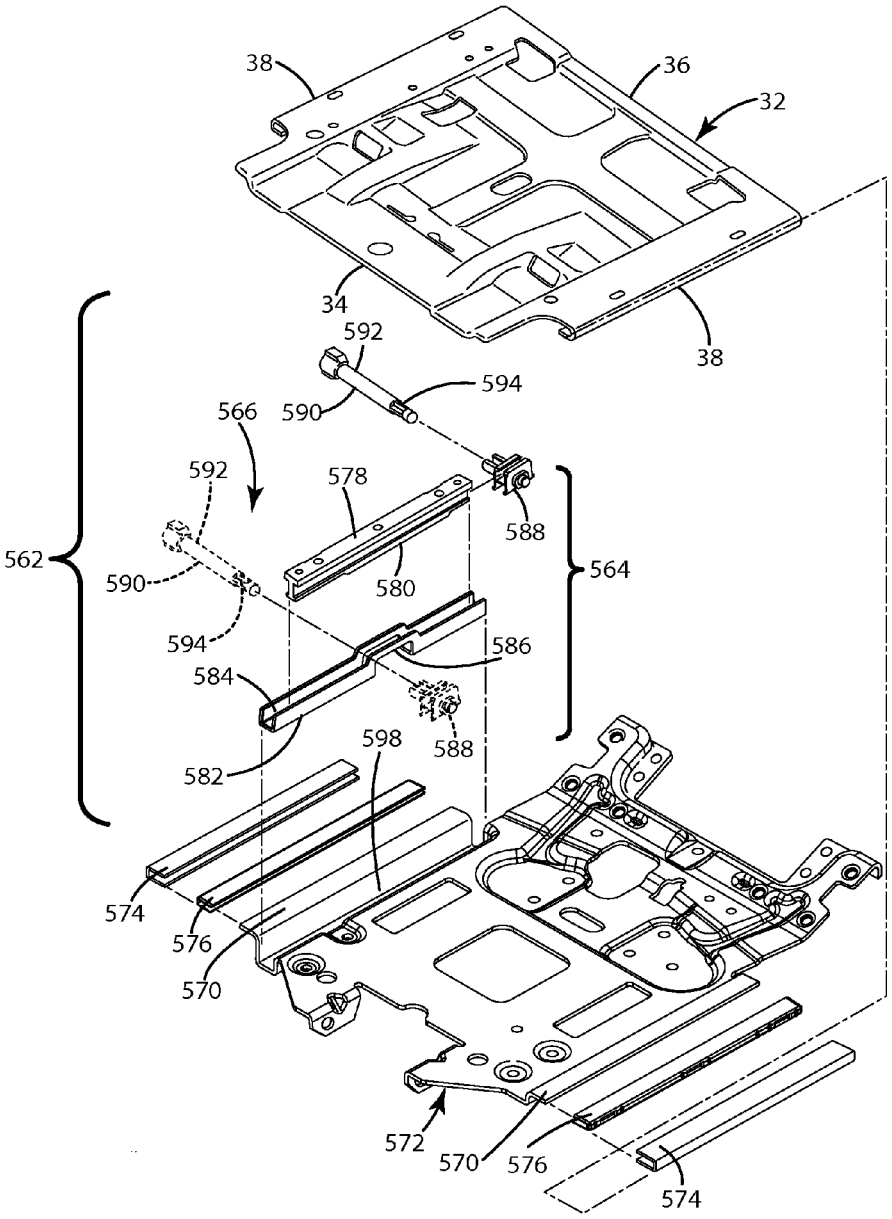
FIG. 37 is an exploded perspective view of the direct drive assembly.

As noted above, the seat assembly 16 is longitudinally shiftable with respect to the control assembly 14 between a retracted position C and an extended position D (FIG. 3). As best illustrated in FIGS. 19, 36 and 37, a direct drive assembly 562 includes a drive assembly 564 and a linkage assembly 566 that couples the control input assembly 260 with the drive assembly 564, thereby allowing a user to adjust the linear position of the seat by adjusting the linear position of the seat assembly 16 with respect to the control assembly 14. In the illustrated example, the seat support plate 32 includes the C-shaped guiderails 38 which wrap about and slidably engage corresponding guide flanges 570 of a control plate 572 of the control assembly 14. A pair of C-shaped, longitudinally extending connection rails 574 are positioned within the corresponding guiderails 38 and are coupled with a seat support plate 32. A pair of C-shaped bushing members 576 extend longitudinally within the connection rails 574 and are positioned between the connection rails 574 and the guide flanges 570. The drive assembly 564 includes a rack member 578 having a plurality of downwardly extending teeth 580. The drive assembly 564 further includes a rack guide 582 having a C-shaped cross-sectional configuration defining a channel 584 that slidably receives the rack member 578 therein. The rack guide 582 includes a relief 586 located along the length thereof that matingly receives a bearing member 588 therein. Alternatively, the bearing member 588 may be formed as an integral portion of the rack guide 582. The drive assembly 564 further includes a drive shaft 590 having a first end universally coupled with the control input assembly 260 and the second end 594 having a plurality of radially-spaced teeth 596. In assembly, the seat support plate 32 is slidably coupled with the control plate 572 as described above, with the rack member 578 being secured to an underside of the seat support plate 32 and the rack guide 582 being secured within an upwardly opening channel 598 of the control plate 572. In operation, an input force exerted by the user to the control input assembly 260 is transferred to the drive assembly 564 via the linkage assembly 566, thereby driving the teeth 596 of the drive shaft 590 against the teeth 580 of the rack member 578 and causing the rack member 578 and the seat support plate 32 to slide with respect to the rack guide 582 and the control plate 572.

Figure 38:
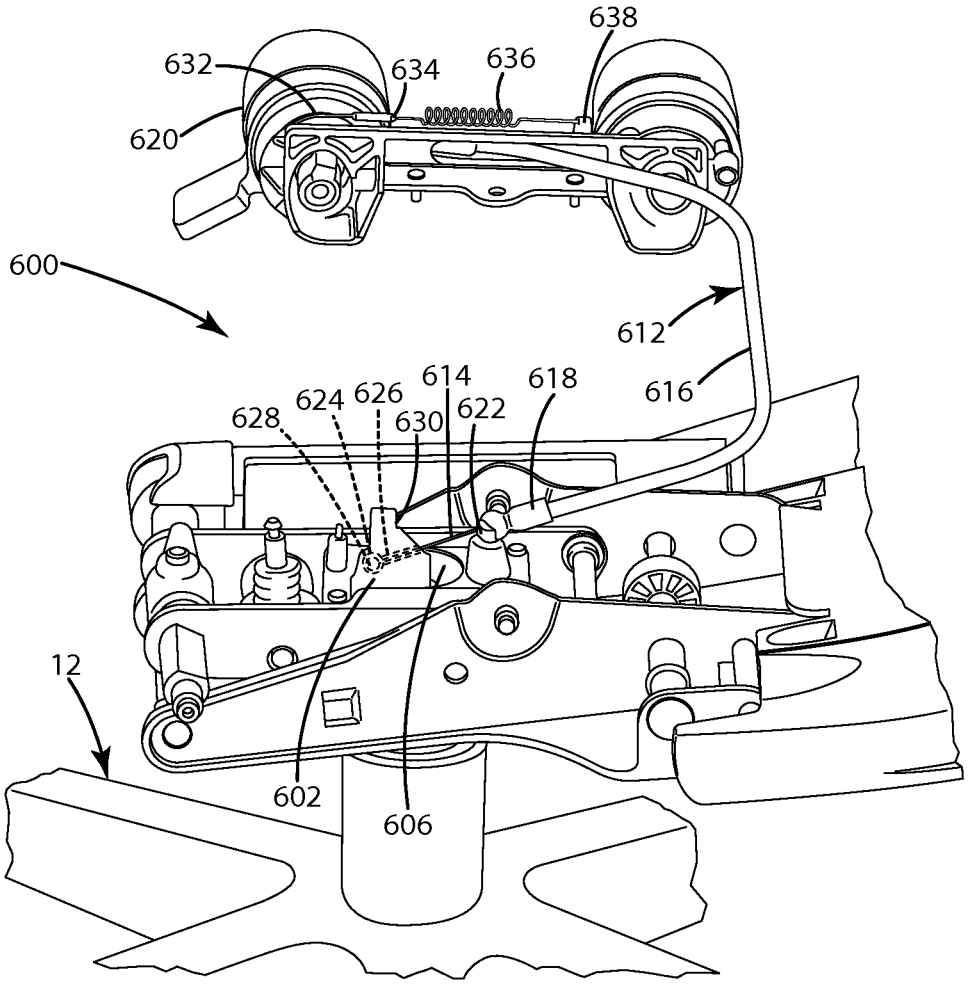
FIG. 38 is a perspective view of a vertical height control assembly.
Figure 39:
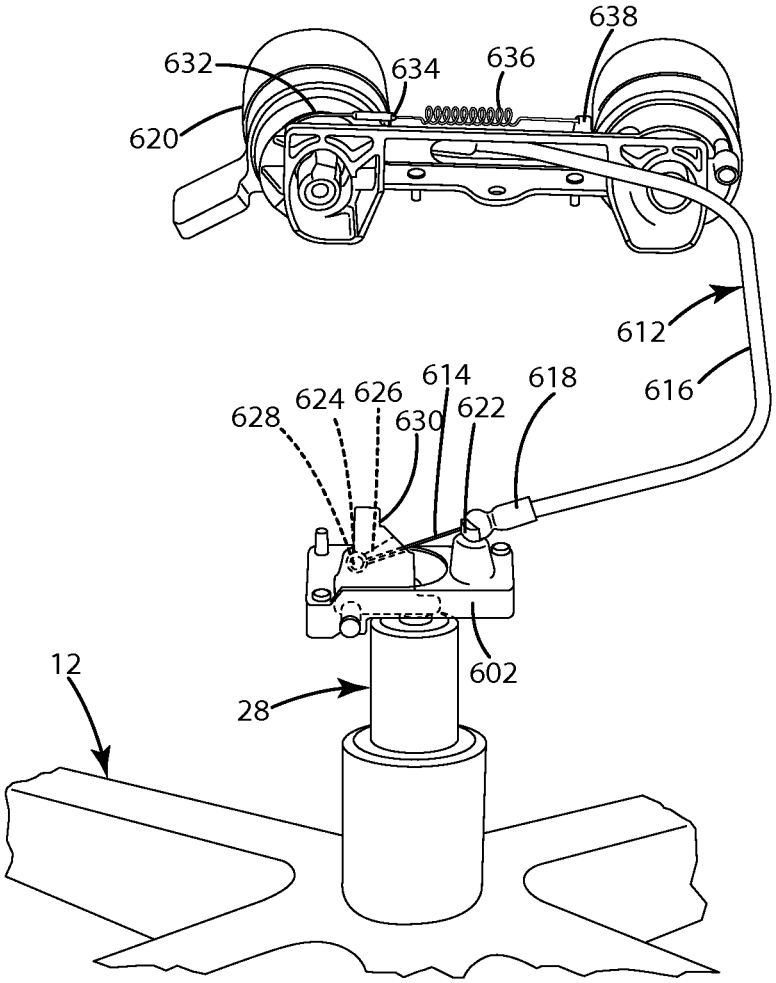
FIG. 39 is a side elevational view of the vertical height control assembly.
Figure 40:
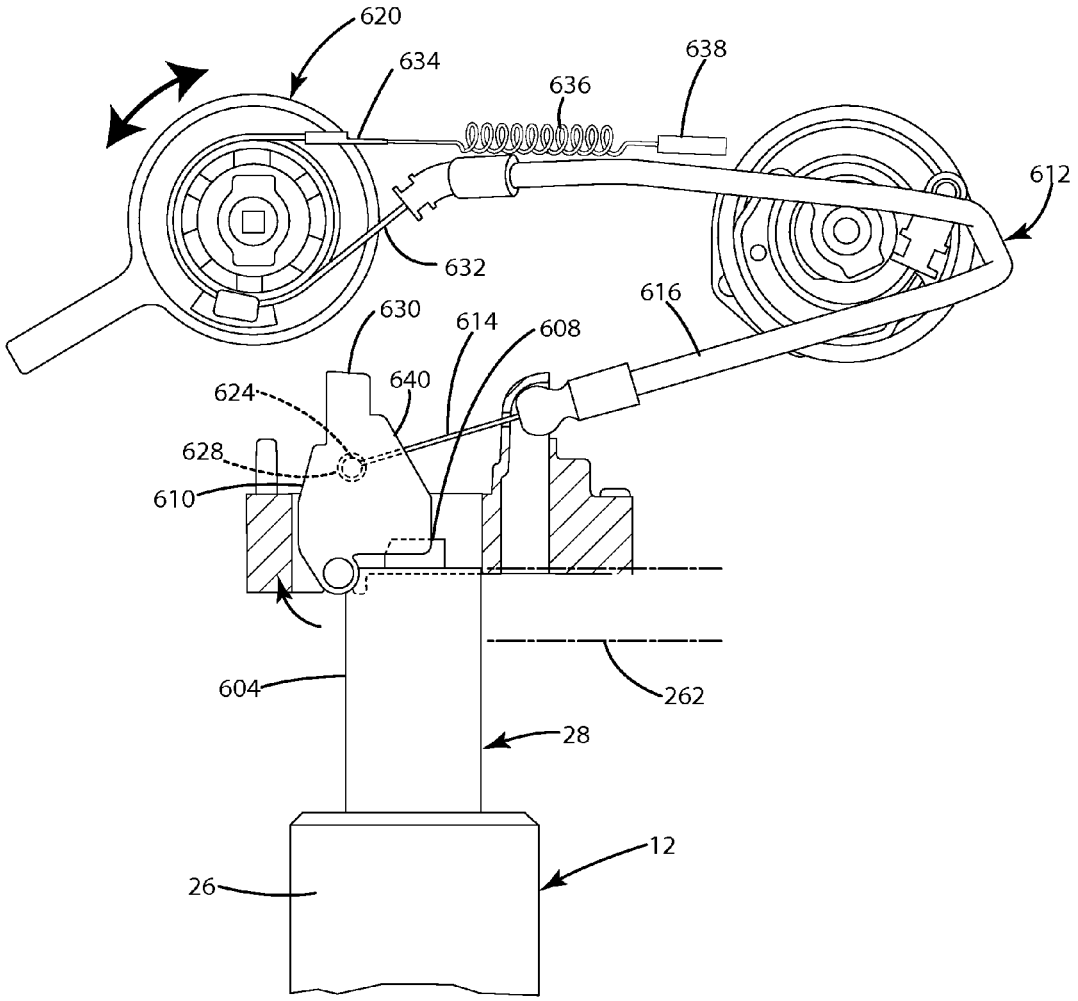
FIG. 40 is a side elevational view of the vertical height control assembly.
Figure 41:
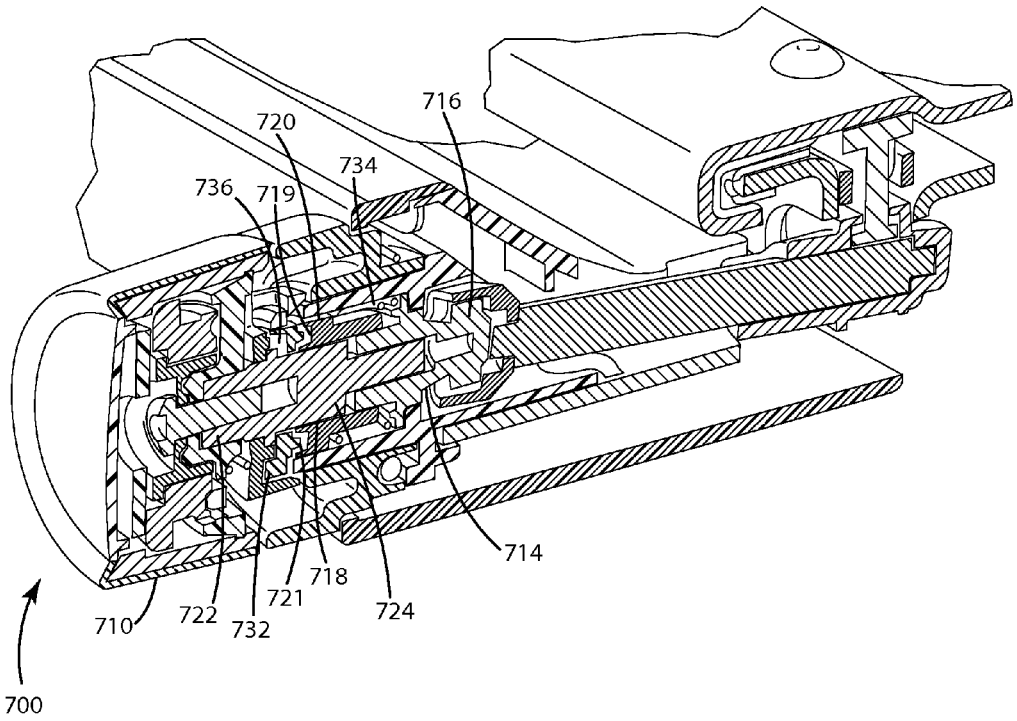
FIG. 41 is a cross-sectional front elevational view of a first input control assembly.
Figures 42A, 42B:
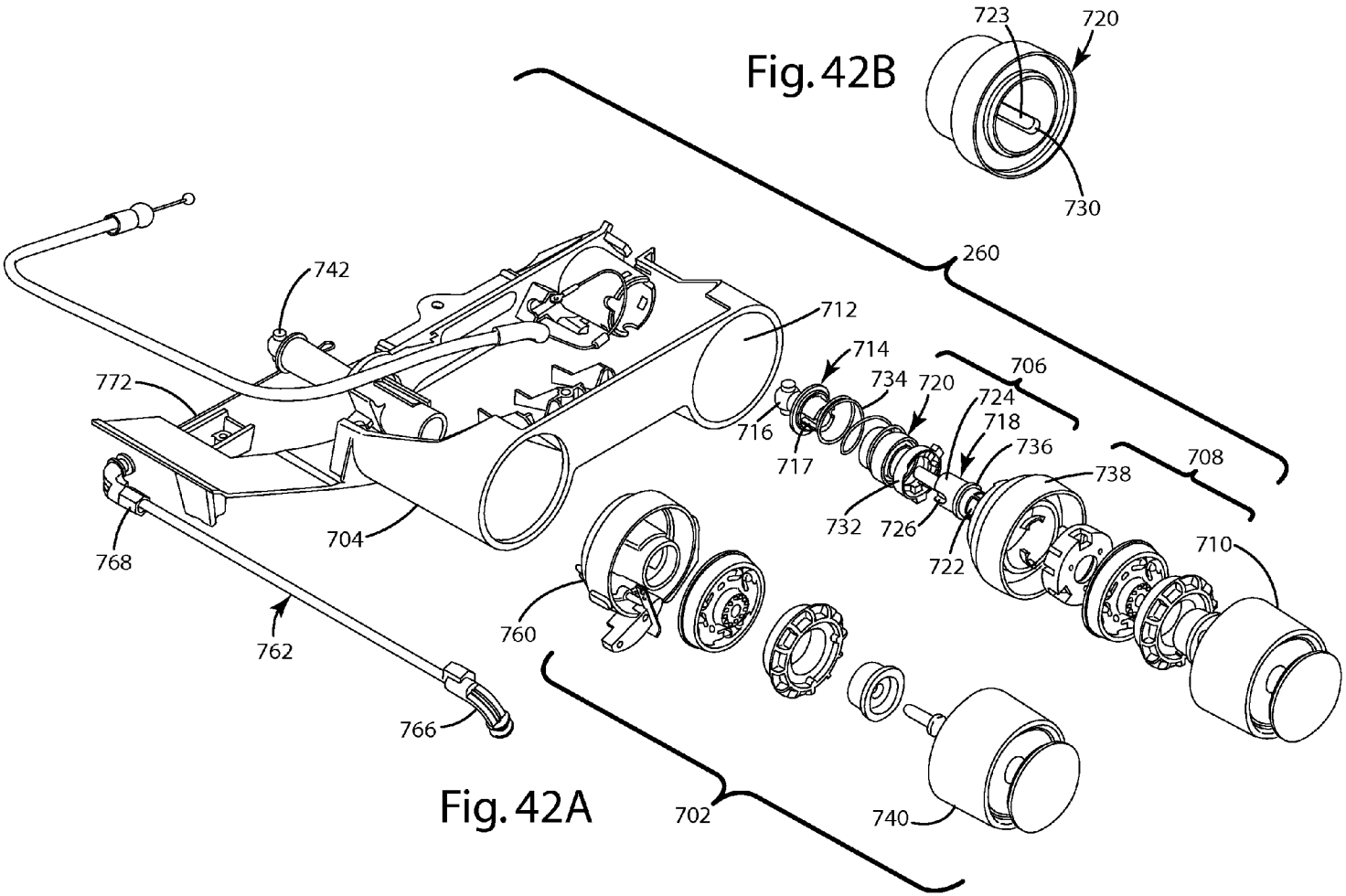
FIG. 42A is an exploded view of a control input assembly.
FIG. 42B is an enlarged perspective view of a clutch member of a first control input assembly.
Figure 42C:
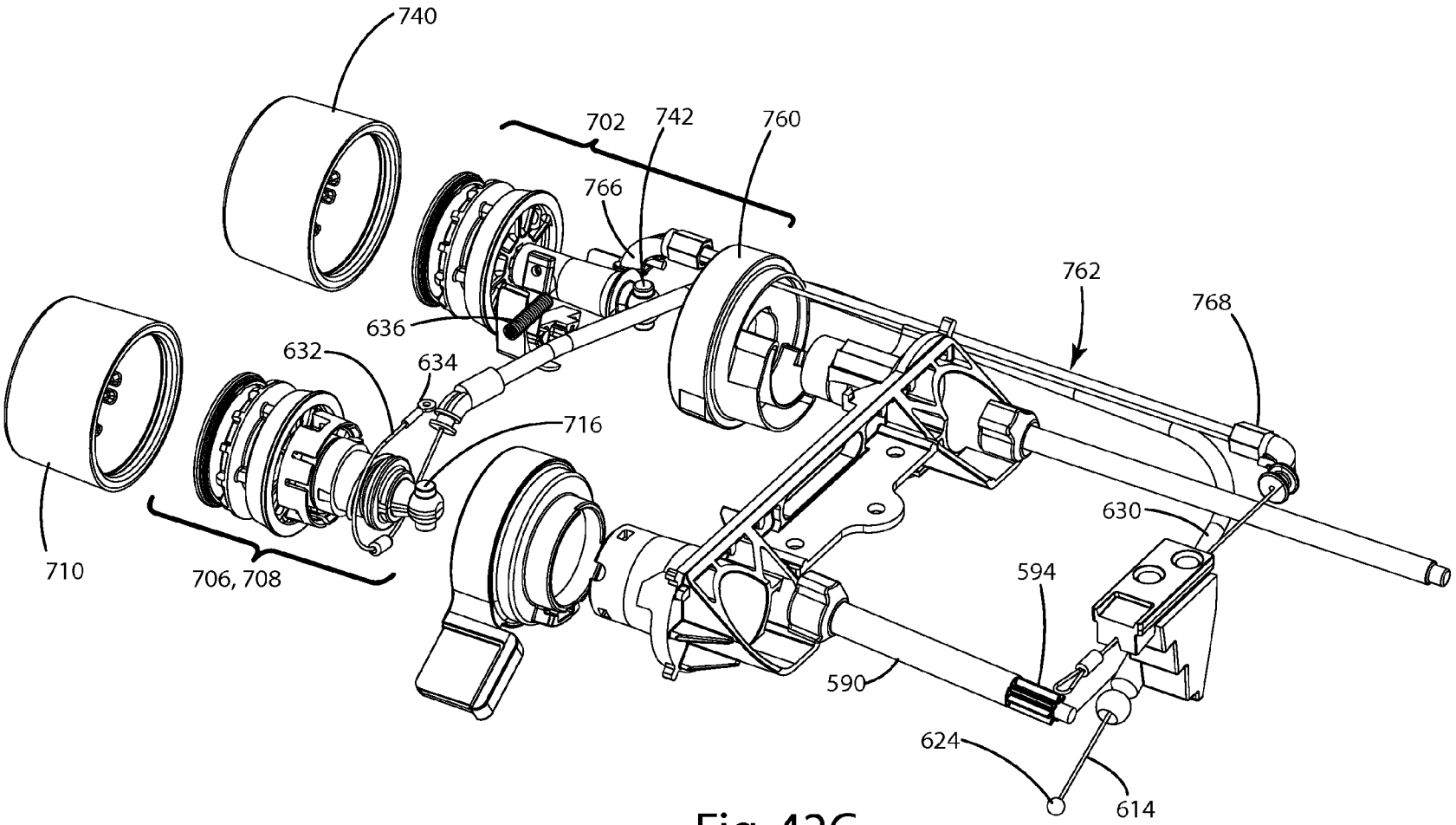
FIG. 42C is a exploded view of the control input assembly.

With further reference to FIGS. 38-40, the chair 10 includes a height adjustment assembly 600 that permits vertical adjustment of seat 16 and back 18 relative to the base assembly 12. Height adjustment assembly 600 includes a pneumatic cylinder 28 that is vertically disposed in central column 26 of base assembly 12 in a known manner.

A bracket structure 602 is secured to housing or base structure 262, and upper end portion 604 of pneumatic cylinder 28 is received in opening 606 (FIG. 39) of base structure 262 in a known manner. Pneumatic cylinder 28 includes an adjustment valve 608 that can be shifted down to release pneumatic cylinder 28 to provide for height adjustment. A bell crank 610, has an upwardly extending arm 630, and a horizontally extending arm 640 that is configured to engage a release valve 608 of pneumatic cylinder 28. Bell crank 610 is rotatably mounted to bracket 602. A cable assembly 612 operably interconnects bell crank 610 with adjustment wheel/lever 620. Cable assembly 612 includes an inner cable 614 and an outer cable or sheath 616. Outer sheath 616 includes a spherical ball fitting 618 that is rotatably received in a spherical socket 622 formed in bracket 602. A second ball fitting 624 is connected to end 626 of inner cable 614. Second ball fitting 624 is rotatably received in a second spherical socket 628 of upwardly extending arm 630 of bell crank 610 to permit rotational movement of the cable end during height adjustment.

A second or outer end portion 632 of inner cable 614 wraps around wheel 620, and an end fitting 634 is connected to inner cable 614. A tension spring 636 is connected to end fitting 634 and to the seat structure at point 638. Spring 636 generates tension on inner cable 614 in the same direction that cable 614 is shifted to rotate bell crank 610 when valve 608 is being released. Although spring 636 does not generate enough force to actuate valve 608, spring 636 does generate enough force to bias arm 640 of bell crank 610 into contact with valve 608. In this way, lost motion or looseness that could otherwise exist due to tolerances in the components is eliminated. During operation, a user manually rotates adjustment wheel 620, thereby generating tension on inner cable 614. This causes bell crank 610 to rotate, causing arm 640 of bell crank 610 to press against and actuate valve 608 of pneumatic cylinder 28. An internal spring (not shown) of pneumatic cylinder 28 biases valve 608 upwardly, causing valve 608 to shift to a non-actuated position upon release of adjustment wheel 620.

The control input assembly 260 (FIGS. 19 and 41-43) comprises a first control input assembly 700 and a second control input assembly 702 each adapted to communicate inputs from the user to the chair components and features coupled thereto, and housed within a housing assembly 704. The control input assembly 260 includes an anti-back drive assembly 706, an overload clutch assembly 708, and a knob 710. The anti-back drive mechanism or assembly 706 prevents the direct drive assembly 562 (FIGS. 36 and 37) and the seat assembly 16 from being driven between the retracted and extended positions C, D without input from the control assembly 700. The anti-back drive assembly 706 is received within an interior 712 of the housing assembly 704 and includes an adaptor 714 that includes a male portion 716 of a universal adaptor coupled to the second end 594 of the drive shaft 590 (FIG. 37) at one end thereof, and including a spline connector 717 at the opposite end. A cam member 718 is coupled with the adaptor 714 via a clutch member 720. Specifically, the cam member 718 includes a spline end 722 coupled for rotation with the knob 710, and a cam end 724 having an outer cam surface 726. The clutch member 720 includes an inwardly disposed pair of splines 723 that slidably engage the spline connector 717 having a cam surface 730 that cammingly engages the outer cam surface 726 of the cam member 718, as described below. The clutch member 720 has a conically-shaped clutch surface 719 that is engagingly received by a locking ring 732 that is locked for rotation with respect to the housing assembly 704 and includes a conically-shaped clutch surface 721 corresponding to the clutch surface 719 of the clutch member 720, and cooperating therewith to form a cone clutch. A coil spring 734 biases the clutch member 720 towards engaging the locking ring 732.

Without input, the biasing spring 734 forces the conical surface of the clutch member 720 into engagement with the conical surface of the locking ring 732, thereby preventing the "back drive" or adjustment of the seat assembly 16 between the retracted and extended positions C, D, simply by applying a rearward or forward force to the seat assembly 16 without input from the first control input assembly 700. In operation, an operator moves the seat assembly 16 between the retracted and extended positions C, D by actuating the direct drive assembly 562 via the first control input assembly 700. Specifically, the rotational force exerted on the knob 710 by the user is transmitted from the knob 700 to the cam member 718. As the cam member 718 rotates, the outer cam surface 726 of the cam member 718 acts on the cam surface 730 of the clutch member 720, thereby overcoming the biasing force of the spring 734 and forcing the clutch member 720 from an engaged position, wherein the clutch member 720 disengages the locking ring 732. The rotational force is then transmitted from the cam member 718 to the clutch member 720, and then to the adaptor 714 which is coupled to the direct drive assembly 762 via the linkage assembly 566.

It is noted that a slight amount of tolerance within the first control input assembly 700 allows a slight movement (or "slop") of the cam member 718 in the linear direction and rotational direction as the clutch member 720 is moved between the engaged and disengaged positions. A rotational ring-shaped damper element 736, comprising a thermoplastic elastomer (TPE), is located within the interior 712 of the housing 704, and is attached to the clutch member 720. In the illustrated example, the damping element 736 is compressed against and frictionally engages the inner wall of the housing assembly 704.

The first control input assembly 700 also includes a second knob 738 adapted to allow a user to adjust the vertical position of the chair assembly between the lowered position A and the raised position B, as described below.

The second control input assembly 702 is adapted to adjust the tension exerted on the back assembly 18 during recline, and to control the amount of recline of the back assembly 18. A first knob 740 is operably coupled to the moment arm shift assembly 466 by the moment arm shift linkage assembly 470. Specifically, the second control input assembly 702 includes a male universal coupling portion 742 that couples with the female universal coupler portion of the shaft 486 of the moment arm shift linkage assembly 470.

Figure 43:
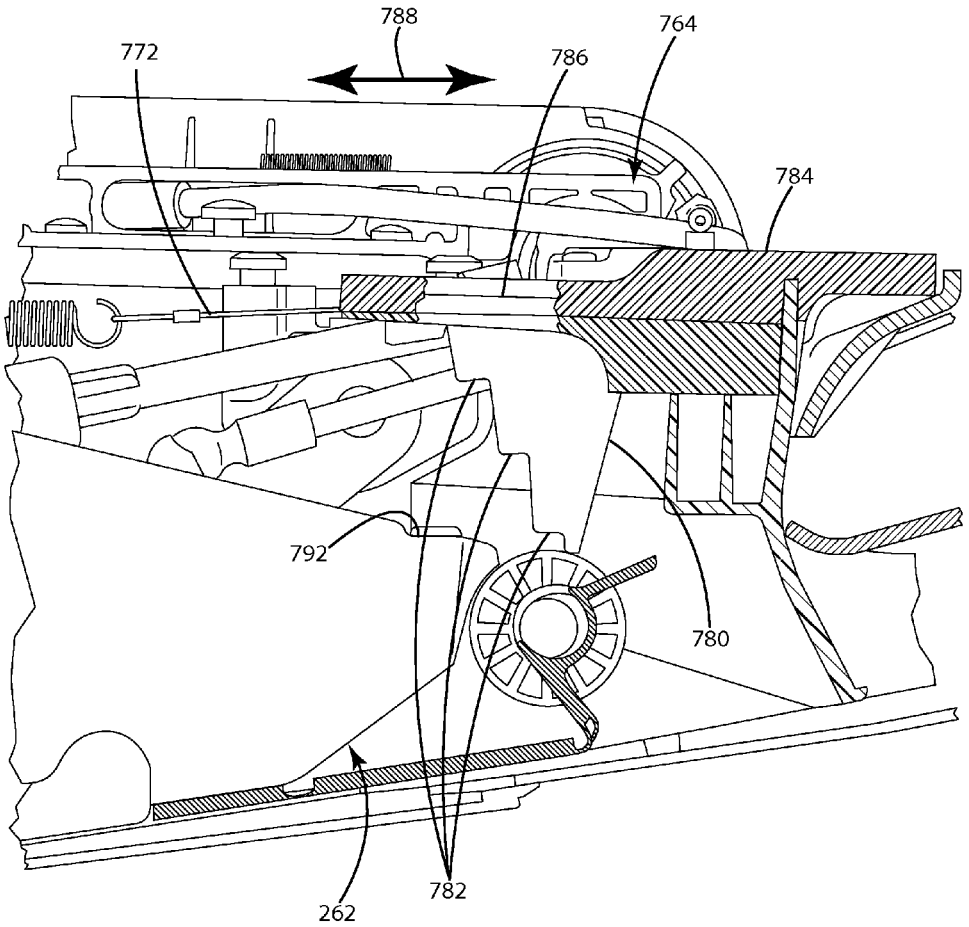
FIG. 43 is a side perspective view of a variable back control assembly.

A second knob 760 is adapted to adjust the amount of recline of the back assembly 18 via a cable assembly 762 operably coupling the second knob 760 to a variable back stop assembly 764 (FIG. 43). The cable assembly 762 includes a first cable routing structure 766, a second cable routing structure 768 and a cable tube 770 extending therebetween and slidably receiving an actuator cable 772 therein. The cable 772 includes a distal end 774 that is fixed with respect to the base structure 262, and is biased in a direction 776 by a coil spring 778. The variable back stop assembly 764 includes a stop member 780 having a plurality of vertically graduated steps 782, a support bracket 784 fixedly supported with respect to the seat assembly 16, and a slide member 786 slidably coupled to the support bracket 784 to slide in a fore-to-aft direction 788, and fixedly coupled to the stop member 780 via a pair of screws 790. The cable 772 is clamped between the stop member 780 and the slide member 784 such that longitudinal movement of the cable 772 causes the stop member 780 to move in the fore-and-aft direction 788. In operation, a user adjusts the amount of back recline possible by adjusting the location of the stop member 780 via an input to the second knob 760. The amount of back recline available is limited by which select step 782 of the stop member 780 contacts a rear edge 792 of the base structure 262 as the back assembly 18 moves from the upright towards the reclined position.

Figure 44:
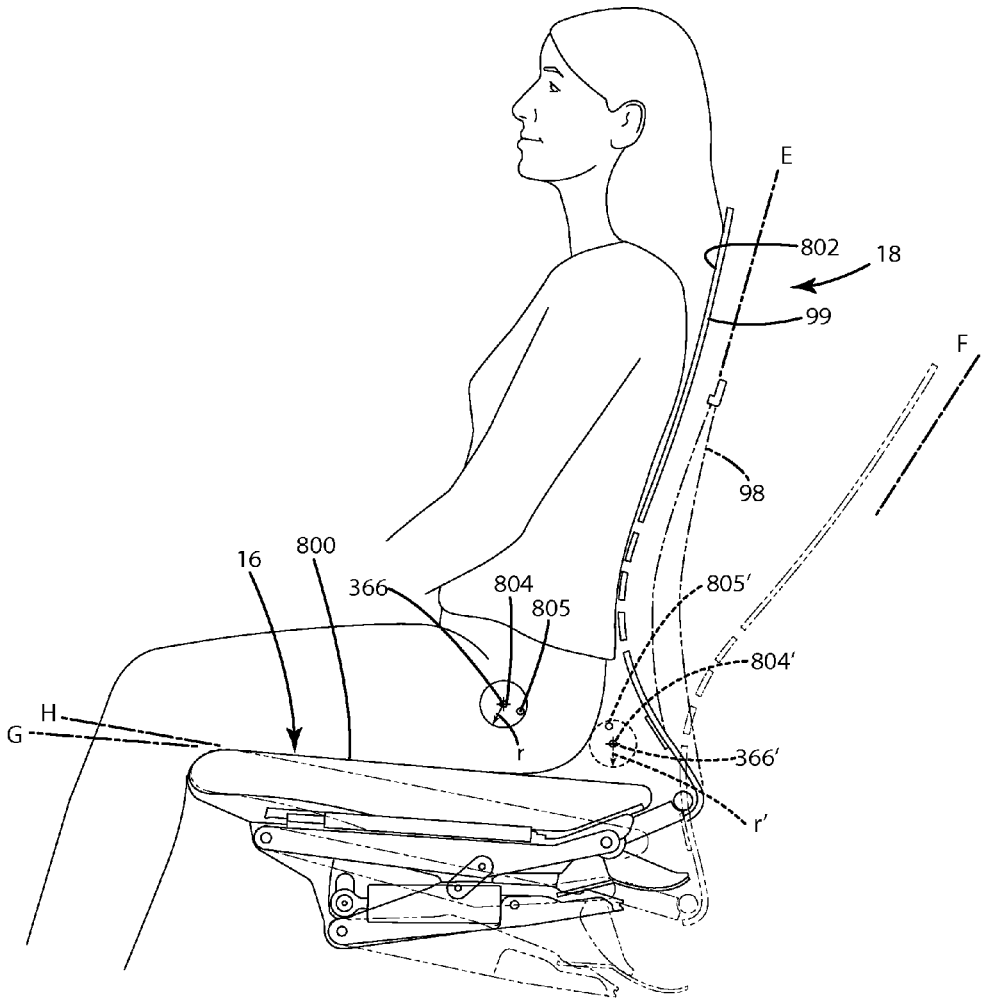
FIG. 44 is a cross-sectional side view of the chair assembly showing pivot points of the seat assembly and the back assembly, and the H-point of a seated user when the seat and back assemblies are in the upright and reclined positions.

As discussed above, a seat user's spine and femur rotate about the H-point 366 (FIG. 44) as the back assembly 18 (FIG. 4) is rotated between the fully upright position E and the fully reclined position F, and as the seat assembly 16 is moved between the fully upright position G and the fully reclined position H. The H-point is generally defined as the pivot point between a seated user's torso and upper leg portions relative to a supporting floor surface. As illustrated in FIG. 44, the H-point 366 moves between a first position 366 when the seat assembly 16 and back assembly 18 are in the upright positions, and a second position 366' when the seat assembly 16 and the back assembly 18 are in the reclined positions thereof.

Figure 45A:
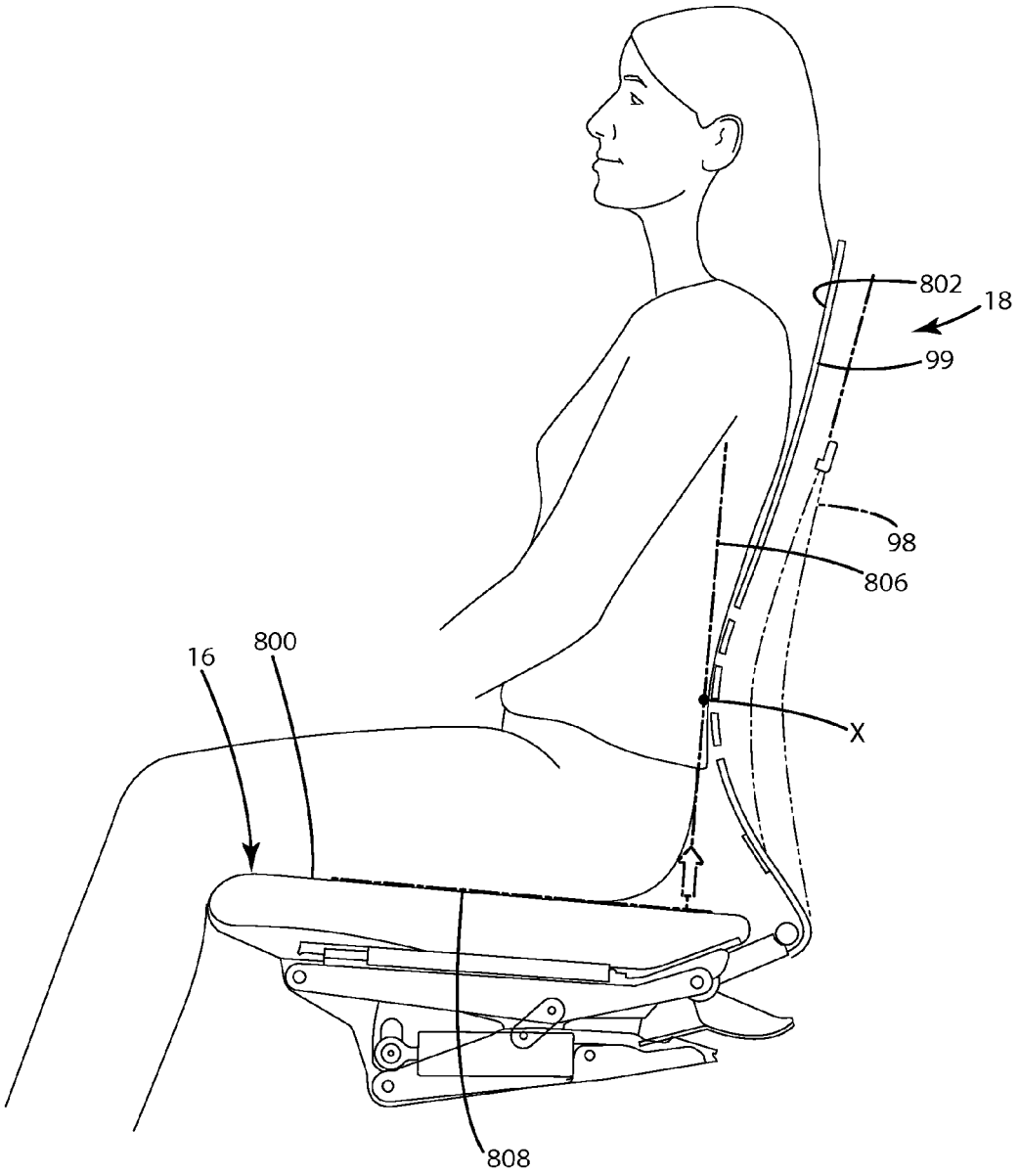
FIGS. 45A-45D are cross-sectional side views of the chair assembly showing calculation of the pivot points of the seat and back assemblies.
Figure 45B:
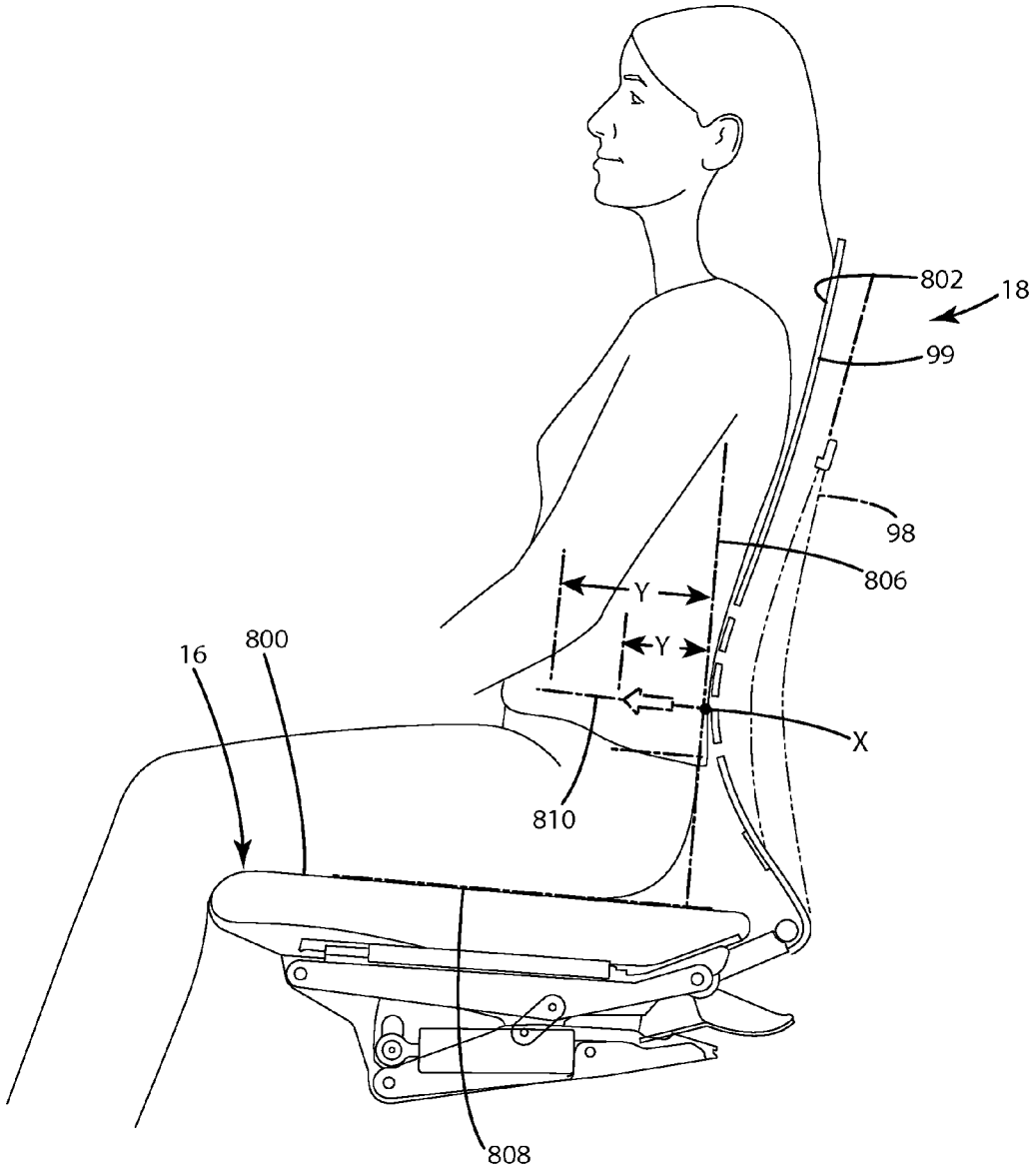
Figure 45C:
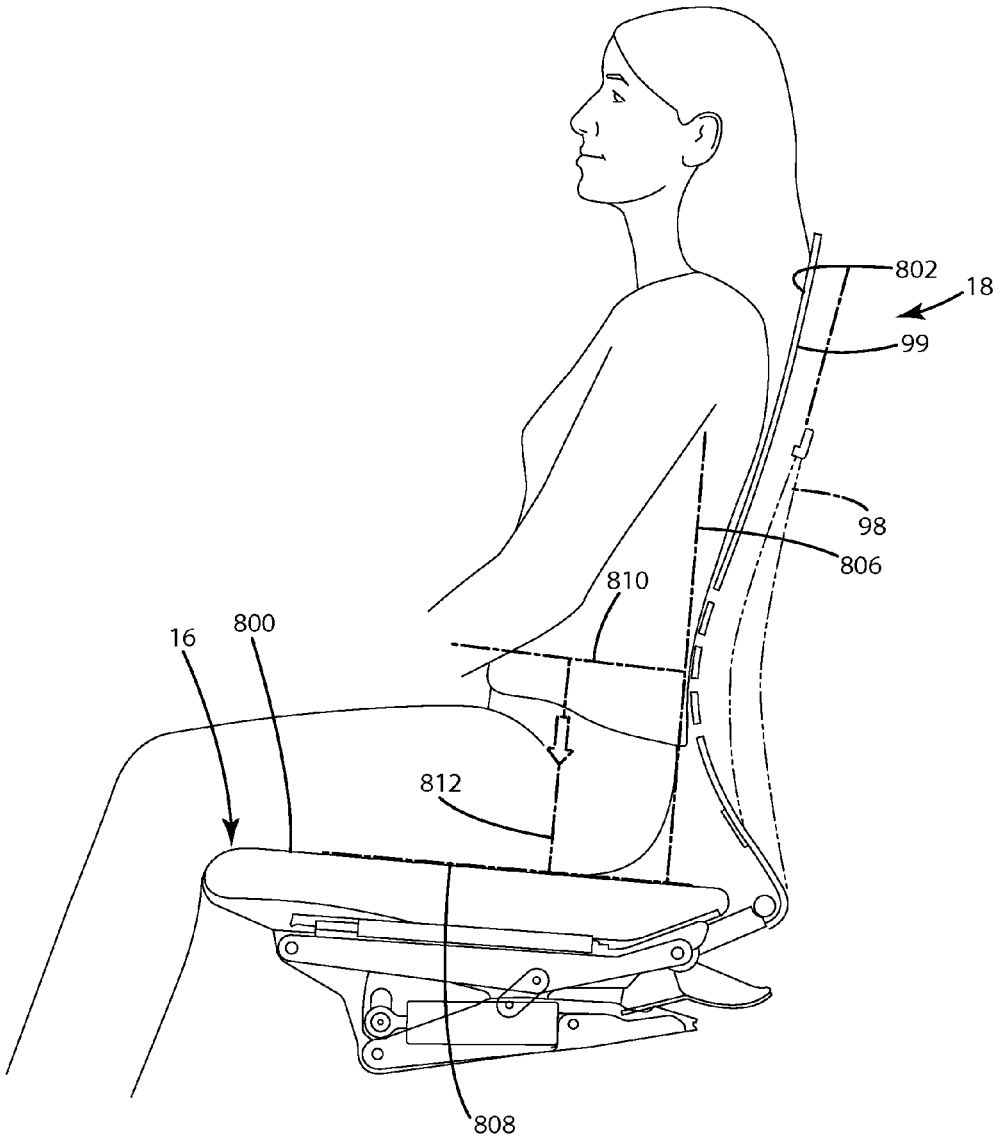
Figure 45D:
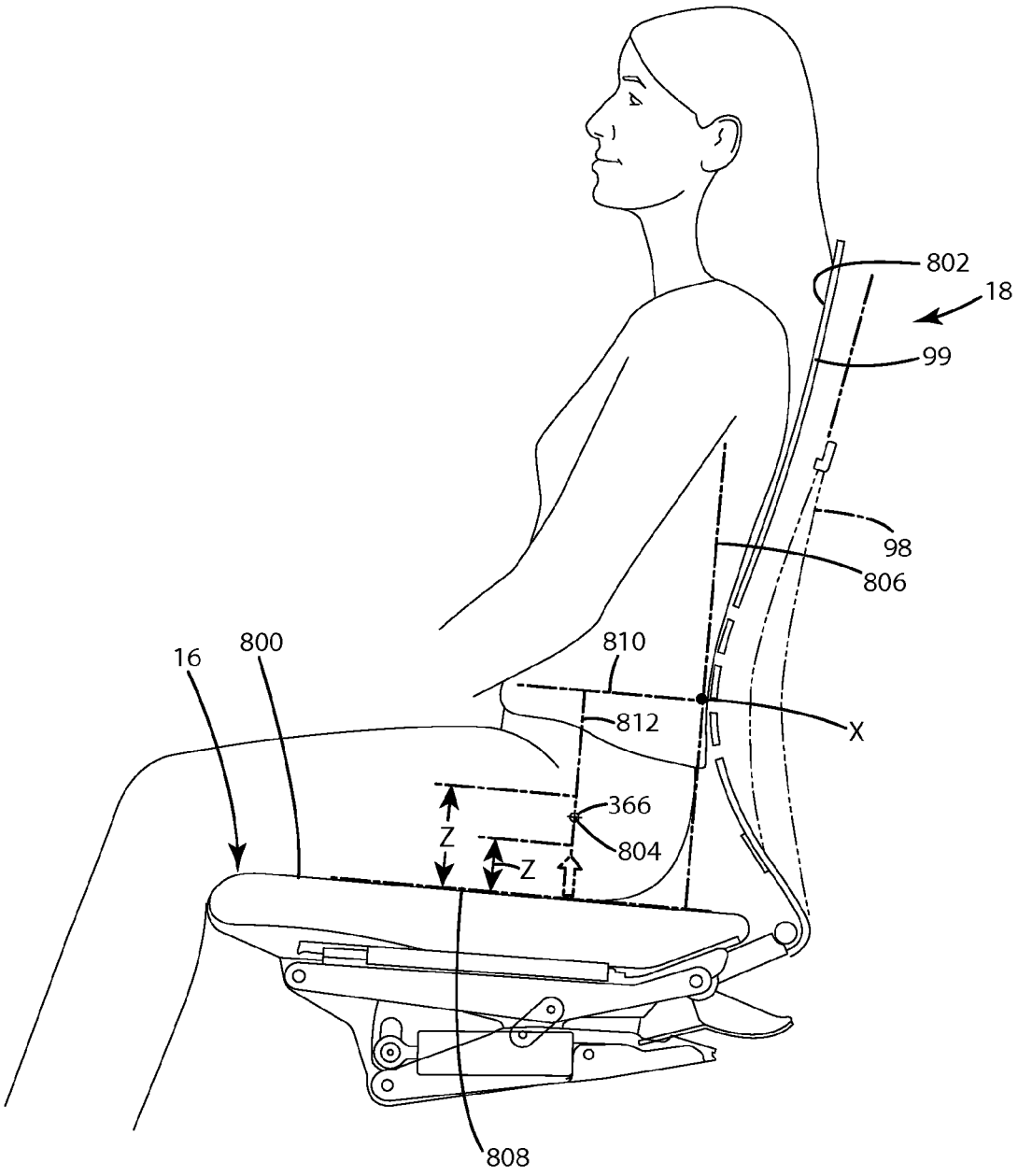

The seat assembly 16 (FIG. 44) includes a seat surface 800 while the back assembly 99 includes a back surface 802 each supporting a portion of seated user. The seat surface 800 and the back surface 802 are each adapted to pivot generally about the H-point 366 as the seat assembly 16 and back assembly 99 are moved between the fully upright and reclined positions thereof. Specifically, the seat surface 800 rotates about a seat pivot point 804 that is collocated with the H-point 366 as the seat assembly 16 is moved between the upright and reclined positions, while the back surface 802 pivots about a back pivot point 805 as the back assembly 18 is moved between the fully upright and reclined positions thereof. In the illustrated example, the pivot point 804 is defined as the point located along a first line 806 (FIG. 45A) extending perpendicular to a second line 808 tangential to the seat surface 800 and tangential with a forward most portion of the back surface 802 located where the first line 806 contacts the back surface 802 at a position X; then from that position forward a distance Y (FIG. 45B) from the first line 806 along a third line 810 that is parallel with the second line 808, wherein the distance Y is between 2.64 inches and 3.64 inches; then from that position down to the second line 808 (FIG. 45C) along a fourth line 812 that is perpendicular to the second line 808; and then up from that position up along the fourth line 812 (FIG. 45D) a distance Z from the second line 808 to define the H-point 366 and the collocated seat pivot point 804, wherein the distance Z is between 2.04 inches and 3.04 inches from the second line 808. Each of the lines 806, 808, 810, 812 extend along the center line of the seat assembly 16 and the back assembly 18.

In operation, the back pivot point 805 preferably remains within a radius of less than or equal to 0.75 inches from the seat pivot point 804 as the seat assembly 16 and back assembly 18 are moved between the upright and reclined positions, more preferably within a radius of less than or equal to 0.5 inches, and most preferably within a radius of less than or equal to 0.375 inches. By reducing the related movement of the seat pivot point 804 and the back pivot point 805 relative to one another and relative to the H-point 366, detrimental effects of having the pivot points and related chair components move away from one another are reduced or eliminated, such as "shirt shear", or the untucking of a seated user's shirt or blouse caused by the back surface moving vertically away from the seat surface during recline of the chair, and lumbar loss, caused by the lumbar area of the back surface falling away from the seat surface again during recline of the chair, wherein the lumbar portion of a seated user's back is not adequately supported.

In the foregoing description, it will be readily appreciated by those skilled in the art that alternative combinations of the various components and elements of the invention and modifications to the invention may be made without departing when the concept is disclosed, such as applying the inventive concepts as disclosed herein to vehicle seating, stadium seating, home seating, and the like. Such modifications are to be considered as included in the following claims, unless these claims by their language expressly state otherwise.

The invention claimed is:

1. A chair assembly, comprising:

a seat support structure including a seat surface adapted to support a seated user, wherein the seat support structure is pivotable about a first pivot point between a first seat position and a second seat position; and a back support assembly operably coupled to the seat support structure and including a back surface adapted to support a seated user, wherein the back support assembly is movable between a fully upright position and fully reclined position, the seat support structure is located in the first seat position when the back support assembly is in the fully upright position and in the second position when the back support assembly is in the fully reclined position, and wherein the back support assembly is pivotable about a second pivot point; and wherein the first pivot point is located at a position along a first line that is perpendicular to a second line tangential to the seat surface and that is tangential with a forward most portion of the back surface located where the first line contacts the back surface, then forward between about 2.6 inches and about 3.7 inches along a third line that is parallel with the second line, then down to the second line along a fourth line perpendicular with the second line, and then up the fourth line between about 2.0 inches and about 3.1 inches from the second line to the first pivot point, and wherein the second pivot point is located within a radius of less than or equal to about 0.75 inches from the first pivot point when the back support assembly is in the fully upright position and within a radius of about 0.75 inches from the first pivot point when the back support assembly is in the fully reclined position.

2. The chair assembly of claim 1, wherein the second pivot point is located within a radius of less than or equal to about 0.5 inches from the first pivot point when the back support assembly is in the fully upright position and when the back support assembly is in the fully reclined position.

3. The chair assembly of claim 2, wherein the second pivot point is located within a radius of less than or equal to about 0.375 inches from the first pivot point when the back support assembly is in the fully upright position and when the back support assembly is in the fully reclined position.

4. The chair assembly of claim 1, wherein the second pivot point remains located within a radius of less than or equal to about 0.75 inches from the first pivot point as the back assembly is moved between the fully upright and the fully reclined positions.

5. The chair assembly of claim 4, wherein the second pivot point remains located within a radius of less than or equal to about 0.5 inches from the first pivot point as the back assembly is moved between the fully upright and the fully reclined positions.

6. The chair assembly of claim 5, wherein the second pivot point remains located within a radius of less than or equal to about 0.375 inches from the first pivot point as the back assembly is moved between the fully upright and the fully reclined positions.

7. The chair assembly of claim 1, further including:

a base structure pivotably coupled to the seat support structure;

a back support structure pivotably coupled to the base structure and operably coupled to the back support assembly; and a control link pivotably coupled to the seat support structure and pivotably coupled to the back support structure, wherein the seat support structure, the back support structure, the base structure, and the control link cooperate to form a four-bar linkage assembly.

8. The chair assembly of claim 7, wherein the back support assembly comprises a flexible shell member having a forwardly curved lower lumbar portion defining a curvature that includes the forward most portion of the back surface.

9. A chair assembly, comprising:

a seat support structure including a seat surface adapted to support a seated user, wherein the seat support structure is pivotable about a first pivot point between a first seat position and a second seat position; and a back support assembly operably coupled to the seat support structure and including a back surface with a lower portion located proximate a lower end of the back surface and adapted to support a seated user, wherein the back support assembly is movable between a fully upright position and fully reclined position, the seat support structure is located in the first seat position when the back support assembly is in the fully upright position and in the second position when the back support assembly is in the fully reclined position, and wherein the back support assembly is pivotable about a second pivot point; and wherein the first pivot point is adapted to be located above the seat surface and forward from the back surface when the back support assembly is in the fully upright position and when the back support assembly is in the fully reclined position, and wherein the second pivot point is adapted to be located within a radius of less than or equal to about 0.75 inches from the first pivot point when the back support assembly is in the fully upright position and when the back support assembly is in the fully reclined position.

10. The chair assembly of claim 9, wherein the second pivot point is located within a radius of less than or equal to about 0.5 inches from the first pivot point when the back support assembly is in the fully upright position and when the back support assembly is in the fully reclined position.

11. The chair assembly of claim 10, wherein the second pivot point is located within a radius of less than or equal to about 0.375 inches from the first pivot point when the back support assembly is in the fully upright position and when the back support assembly is in the fully reclined position.

12. The chair assembly of claim 9, wherein the second pivot point remains located within a radius of less than or equal to about 0.75 inches from the first pivot point as the back assembly is moved between the fully upright and the fully reclined positions.

13. The chair assembly of claim 12, wherein the second pivot point remains located within a radius of less than or equal to about 0.5 inches from the first pivot point as the back assembly is moved between the fully upright and the fully reclined positions.

14. The chair assembly of claim 13, wherein the second pivot point remains located within a radius of less than or equal to about 0.375 inches from the first pivot point as the back assembly is moved between the fully upright and the fully reclined positions.

15. The chair assembly of claim 9, further including:

a base structure pivotably coupled to the seat support structure; and a back support structure pivotably coupled to the base structure and operably coupled to the back support assembly; and a control link pivotably coupled to the seat support structure and pivotably coupled to the back support structure, wherein the seat support structure, the back support structure, the base structure and the control link cooperate to form a four-bar linkage assembly.

16. The chair assembly of claim 15, wherein the back support assembly comprises a flexible shell member.

17. A chair assembly, comprising:

a seat support structure including a seat surface adapted to support a seated user, wherein the seat support structure is pivotable about a first pivot point between a first seat position and a second seat position; and a back support assembly operably coupled to the seat support structure and including a back surface with a lower portion located proximate a lower end of the back surface and adapted to support a seated user, wherein the back support assembly is movable between a fully upright position and fully reclined position, the seat support structure is located in the first seat position when the back support assembly is in the fully upright position and in the second position when the back support assembly is in the fully reclined position, and wherein the back support assembly is pivotable about a second pivot point; and wherein the first pivot point is located above the seat surface and forward from the back surface when the back support assembly is in the fully upright position and when the back support assembly is in the fully reclined position, and wherein the second pivot point is adapted to be located within a radius of less than or equal to about 0.75 inches from the first pivot point when the back support assembly is in the fully upright position and when the back support assembly is in the fully reclined position.

18. The chair assembly of claim 17, wherein the second pivot point is located within a radius of less than or equal to about 0.5 inches from the first pivot point when the back support assembly is in the fully upright position and when the back support assembly is in the fully reclined position.

19. The chair assembly of claim 18, wherein the second pivot point is located within a radius of less than or equal to about 0.375 inches from the first pivot point when the back support assembly is in the fully upright position and when the back support assembly is in the fully reclined position.

20. The chair assembly of claim 17, wherein the second pivot point remains located within a radius of less than or equal to about 0.75 inches from the first pivot point as the back assembly is moved between the fully upright and the fully reclined positions.

21. The chair assembly of claim 20, wherein the second pivot point remains located within a radius of less than or equal to about 0.5 inches from the first pivot point as the back assembly is moved between the fully upright and the fully reclined positions.

22. The chair assembly of claim 21, wherein the second pivot point remains located within a radius of less than or equal to about 0.375 inches from the first pivot point as the back assembly is moved between the fully upright and the fully reclined positions.

23. The chair assembly of claim 17, further including:

a base structure pivotably coupled to the seat support structure; and a back support structure pivotably coupled to the base structure and operably coupled to the back support assembly; and a control link pivotably coupled to the seat support structure and pivotably coupled to the back support structure, wherein the seat support structure, the back support structure, the base structure and the control link cooperate to form a four-bar linkage assembly.

24. The chair assembly of claim 23, wherein the back support assembly comprises a flexible shell member.

* * * * *